US010619828B2

(12) United States Patent
Tremaine et al.

(10) Patent No.: US 10,619,828 B2
(45) Date of Patent: Apr. 14, 2020

(54) BENDABLE LED LIGHTING FIXTURE

(71) Applicant: QTran, Inc., Milford, CT (US)

(72) Inventors: John M. Tremaine, New Canaan, CT (US); Adrian R. Teschemaker, West Haven, CT (US); Irving M. Heredia, New Britain, CT (US)

(73) Assignee: QTran, Inc., Milford, CT (US)

( * ) Notice: Subject to any disclaimer, the term of this patent is extended or adjusted under 35 U.S.C. 154(b) by 0 days.

(21) Appl. No.: 15/815,054

(22) Filed: Nov. 16, 2017

(65) Prior Publication Data

US 2018/0306413 A1 Oct. 25, 2018

Related U.S. Application Data

(63) Continuation-in-part of application No. 29/604,628, filed on May 18, 2017, now Pat. No. Des. 850,707, and a continuation-in-part of application No. 29/604,630, filed on May 18, 2017, now Pat. No. Des. 863,646.

(60) Provisional application No. 62/446,475, filed on Jan. 15, 2017, provisional application No. 62/423,109, filed on Nov. 16, 2016.

(51) Int. Cl.

| | |
|---|---|
| ***F21V 15/01*** | (2006.01) |
| ***F21V 31/04*** | (2006.01) |
| ***F21S 4/22*** | (2016.01) |
| ***F21Y 103/10*** | (2016.01) |
| ***F21V 11/02*** | (2006.01) |
| ***F21Y 115/10*** | (2016.01) |
| ***F21V 3/00*** | (2015.01) |

(52) U.S. Cl.
CPC ..... *F21V 15/012* (2013.01); *F21S 4/22* (2016.01); *F21V 31/04* (2013.01); *F21V 3/00* (2013.01); *F21V 11/02* (2013.01); *F21Y 2103/10* (2016.08); *F21Y 2115/10* (2016.08)

(58) Field of Classification Search
CPC ..... F21V 15/012; F21V 3/00; F21V 11/02; F21V 31/04; F21Y 2103/10; F21Y 2115/10
See application file for complete search history.

(56) References Cited

U.S. PATENT DOCUMENTS 6,582,103 B1 * 6/2003 Popovich ..... F21V 5/02 361/224
7,578,605 B1 8/2009 Mullins et al.
9,142,736 B2 9/2015 Qiu et al.
(Continued)

OTHER PUBLICATIONS

Resin Designs, LLC; "Entex 53061"; Soft Polyurethane Encapsulant; Product Data Sheet; Mar. 2016; whole document.
(Continued)

*Primary Examiner* — Mary Ellen Bowman
(74) *Attorney, Agent, or Firm* — Ware, Fressola, Barber & Maguire LLP

(57) ABSTRACT

The present invention generally relates to a bendable lighting fixture, and more particularly to a bendable light emitting diode (LED) lighting fixture containing a lighting element, for example an LED lighting strip, that is configured to be flexed in one or more directions. Exemplary embodiments of the present invention are directed to a bendable lighting fixture that is configured to be flexed and/or bent along at least one direction of the surface on which the bendable lighting fixture may be mounted to.

10 Claims, 46 Drawing Sheets

(56) References Cited

U.S. PATENT DOCUMENTS

| | | | | |
|---|---|---|---|---|
| 9,166,131 | B2 | 10/2015 | Sun et al. | |
| 9,219,205 | B2 | 12/2015 | Diana et al. | |
| 9,236,537 | B2 | 1/2016 | Chew | |
| 9,840,610 | B2 | 12/2017 | Park et al. | |
| 2012/0293086 | A1* | 11/2012 | Ishikita | F21V 15/015 315/201 |
| 2015/0260361 | A1* | 9/2015 | Cho | F21V 31/005 362/249.04 |
| 2015/0308669 | A1* | 10/2015 | Moreno | F21V 31/005 362/157 |

OTHER PUBLICATIONS

Resin Designs, LLC; "Entex 53071"; Soft Polyurethane Encapsulant; Product Data Sheet; Mar. 2016; whole document.

Resin Designs, LLC; "Urethanes in LED Ancapsulation—PT2"; Resin Designs News; http://resindesigns.com/2016/08/18/urethanes-pt-2-in-led-encapsulation; Aug. 18, 2016; whole article.

* cited by examiner

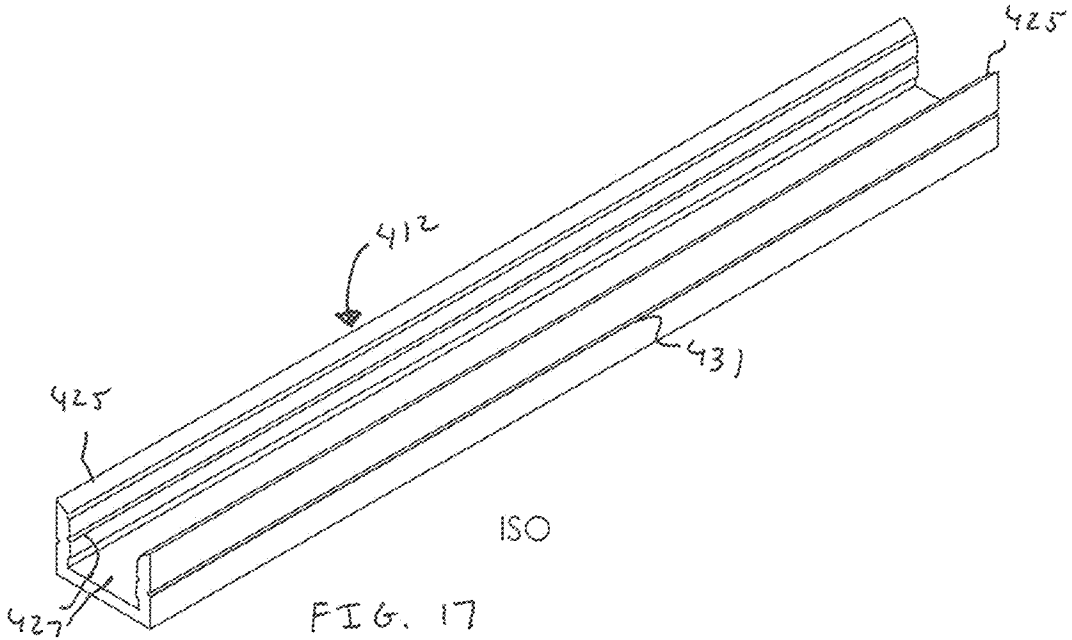
ISO
FIG. 17
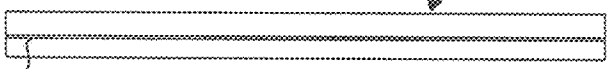
RIGHT SIDE
FIG. 19
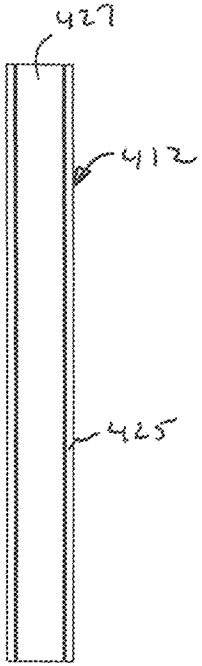
TOP FIG. 16
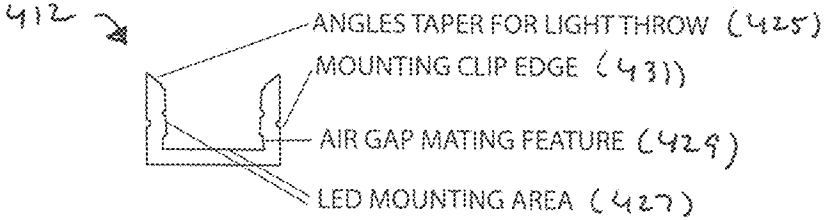
FRONT
FIG. 18

ISO

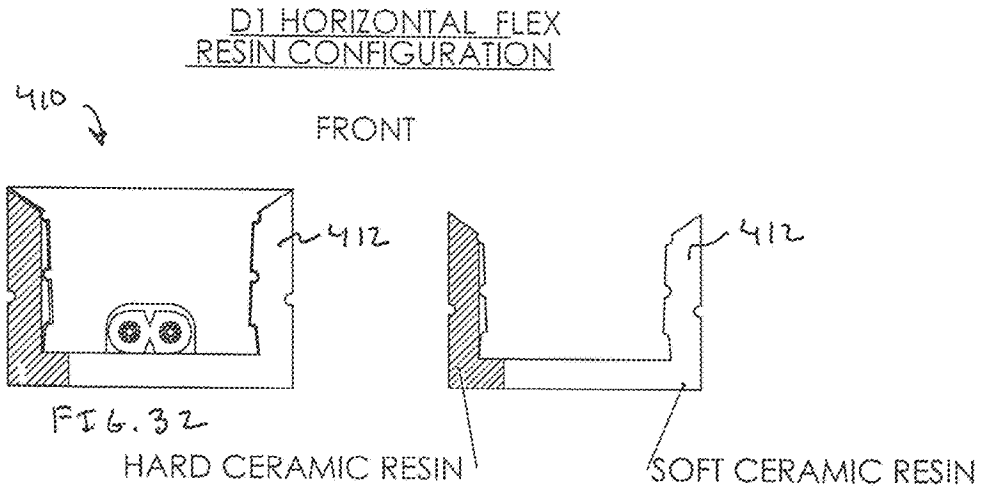
FIG. 30A
FIG. 32
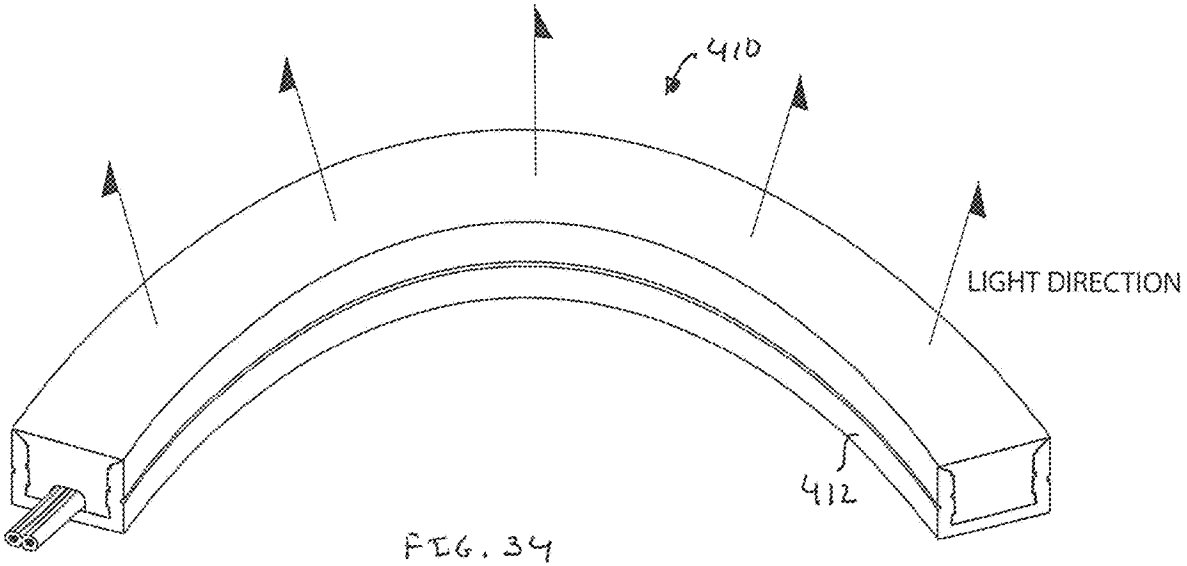
FIG. 34

BENDABLE LED LIGHTING FIXTURE

CROSS-REFERENCE TO RELATED APPLICATIONS

The present application claims priority to U.S. Provisional Appl. No. 62/423,109 filed Nov. 16, 2016 and U.S. Provisional Appl. No. 62/446,475 filed Jan. 15, 2017, both of which are hereby incorporated by reference in their entireties. This application is also a continuation-in-part of U.S. Design application Ser. No. 29/604,628 filed May 18, 2017, and a continuation-in-part of U.S. Design application Ser. No. 29/604,630 filed May 18, 2017, both of which are hereby incorporated by reference in their entireties.

BACKGROUND OF THE INVENTION

1. Field of the Invention

The present invention generally relates to a bendable lighting fixture, and more particularly to a bendable light emitting diode (LED) lighting fixture containing a lighting element, for example an LED lighting strip, that is configured to be flexed in one or more directions.

SUMMARY OF THE INVENTION

Exemplary embodiments of the present invention are directed to a bendable lighting fixture that is configured to be flexed and/or bent along at least one direction of the surface on which the bendable lighting fixture may be mounted to.

It is an object of the present invention to provide a bendable lighting fixture configured to house a lighting element, for example a light emitting diode (LED) lighting strip, in a substantially water resistant or waterproof flexible housing.

It is another object of the present invention to provide a bendable lighting fixture that is configured to contour to the shape of the surface on which the bendable lighting fixture is mounted.

It is still another object of the present invention to provide a bendable lighting fixture that is configured to flex in one or more directions, but also be resistant to flexing in one or more directions that may be substantially perpendicular to the first one or more directions.

It is another object of the present invention to provide a bendable lighting fixture that is configured for deposition within a walkway and/or driveway surface.

It is yet another object of the present invention to provide a bendable lighting fixture that has UV-stability.

It is still another object of the present invention to provide a bendable lighting fixture that is configured for use in indoor and/or outdoor applications.

It is another object of the present invention to provide a bendable lighting fixture with a translucent polyurethane flexible lens.

It is still another object of the present invention to provide a bendable lighting fixture with a transparent polyurethane flexible lens.

It is yet another object of the present invention to provide a bendable lighting fixture that is configured for indirect lighting applications.

It is another object of the present invention to provide a bendable lighting fixture that is configured to obscure the individual dots of light emitted from a light emitting diode (LED) lighting element disposed within the bendable lighting fixture.

In accordance with an exemplary embodiment of the present invention, a lighting fixture is provided that may include a profile having an interior region configured to house a lighting element therein, and a filling material at least partially encasing the lighting element and disposed within the interior region of the profile.

In accordance with this or another exemplary embodiment of the present invention, the profile and the filling material may be configured to flex in at least one direction.

In accordance with this or another exemplary embodiment of the present invention, the lighting element may include at least one end cap positioned on an end of the profile.

In accordance with this or another exemplary embodiment of the present invention, the lighting element may include a spacer lens disposed between the lighting element and the filling material.

In accordance with this or another exemplary embodiment of the present invention, the profile may include a floor and a pair of walls extending from the floor.

In accordance with this or another exemplary embodiment of the present invention, at least one wall of the pair of walls may extend in a curve from the floor.

In accordance with this or another exemplary embodiment of the present invention, the floor may be composed of a material having rigidity in at least one direction.

In accordance with this or another exemplary embodiment of the present invention, at least one wall of the pair of walls may have rigidity in at least one direction.

In accordance with this or another exemplary embodiment of the present invention, at least one wall of the pair of wall may be configured for positioning the lighting element thereon.

In accordance with this or another exemplary embodiment of the present invention, the floor may be configured for positioning the lighting element thereon.

In accordance with this or another exemplary embodiment of the present invention, the lighting element may be a light emitting diode lighting strip.

In accordance with this or another exemplary embodiment of the present invention, the filling material may be a polyurethane.

In accordance with this or another exemplary embodiment of the present invention, the filling material may be a resin.

In accordance with this or another exemplary embodiment of the present invention, the lighting fixture may also include a louvre positioned within the profile.

BRIEF DESCRIPTION OF THE SEVERAL VIEWS OF THE DRAWINGS

For a fuller understanding of the nature and object of the present invention, reference should be had to the following detailed description taken in connection with the accompanying drawings, in which:

FIG. 16 is a top plan view of an exemplary profile for an exemplary bendable lighting fixture shown in FIG. 21;

FIG. 17 is an isometric view of the exemplary profile for the exemplary bendable lighting fixture shown in FIG. 21;

FIG. 18 is front view of the exemplary profile for the exemplary bendable lighting fixture shown in FIG. 21;

FIG. 19 is side view of the exemplary profile for the exemplary bendable lighting fixture shown in FIG. 21;

FIGS. 30 & 30A are a front view of a profile of an exemplary bendable lighting fixture having mixed material composition;

FIG. 32 is a front view of an exemplary bendable lighting fixture having mixed material composition;

FIG. 34 is an isometric view of exemplary flexing of the exemplary bendable lighting fixture from FIG. 32;

DETAILED DESCRIPTION OF THE INVENTION

Figure 1:
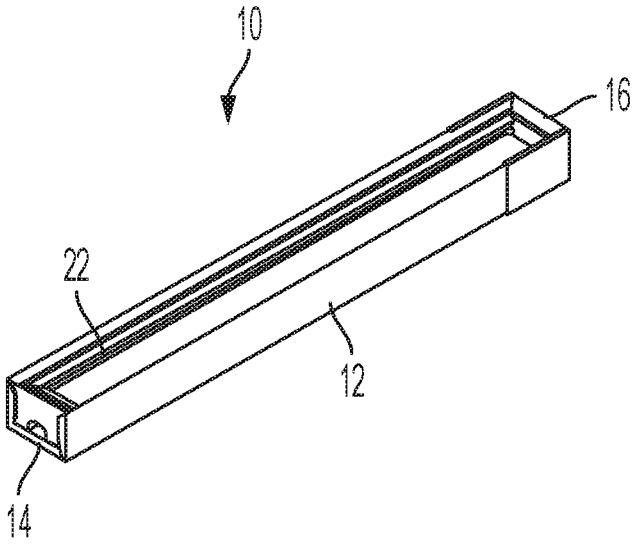
FIG. 1 is an isometric view of an exemplary bendable lighting fixture according to an exemplary embodiment of the present invention.
Figure 1A:
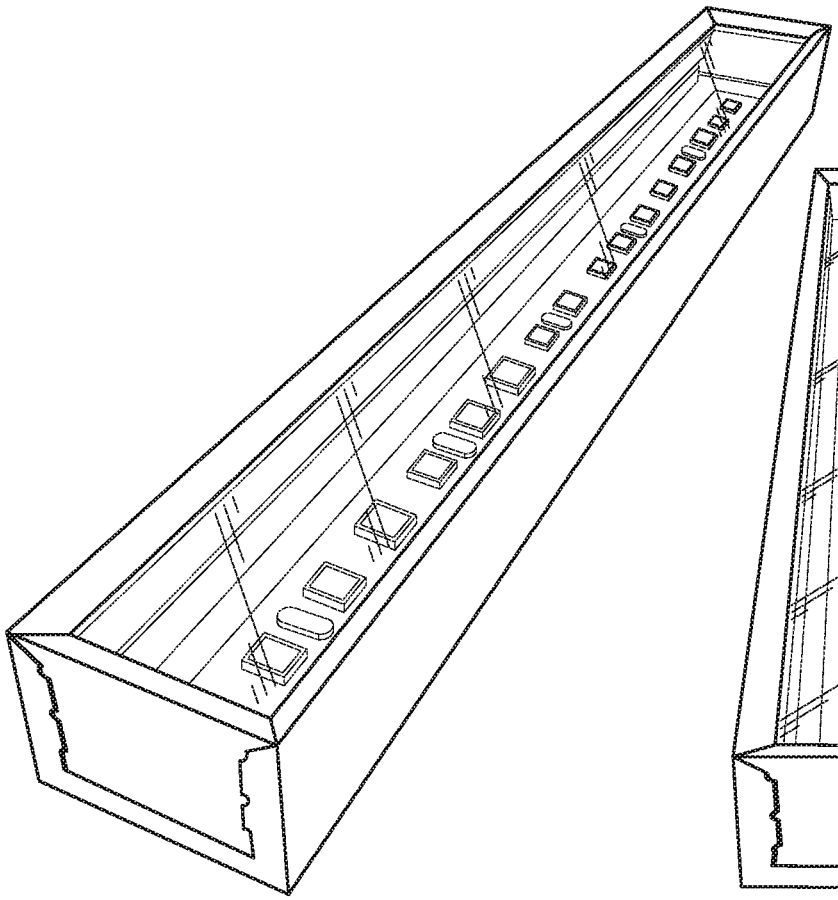
FIG. 1A is an isometric view of the exemplary bendable lighting fixture shown in FIG. 1.
Figure 1B:
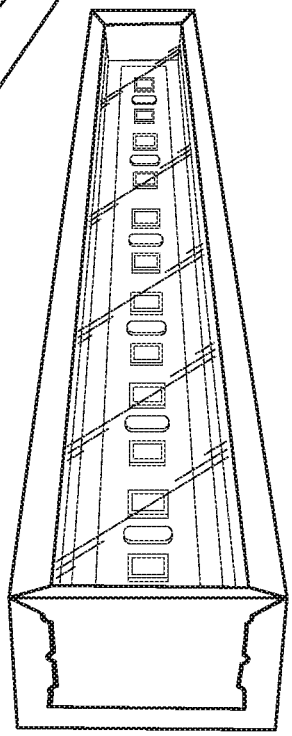
FIG. 1B is an isometric view of the exemplary bendable lighting fixture shown in FIG. 1.

The present invention now will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

Referring now to FIGS. 1, 1A-1D, 2-4 and 4A, therein illustrated is an exemplary embodiment of a bendable lighting fixture, generally indicated by reference numeral 10, according to an exemplary aspect of the present invention. The bendable lighting fixture 10 may include a profile 12, that may be made from a flexible material, such as a flexible plastic, rubber, thermoplastic material, ceramic or polymer. Constructing the profile 12 of a flexible material allows the profile 12 to be bent, flexed and/or twisted in at least one direction relative to the longitudinal axis of the profile 12. The profile 12 of the bendable lighting fixture 10 may include one or more end caps 14, 16 that are configured and dimensioned to be positioned and removably secured at one or more of the ends of the profile 12. It is understood that the end caps 14, 16, although different in configuration, may be configured so that each end cap 14 or 16 may be positioned at each end of the profile 12. One or both end caps 14, 16 may include an opening formed therein to provide a passage for wires to extend from the interior of the bendable lighting fixture 10 to the exterior of the bendable lighting fixture 10. The bendable lighting fixture 10 may be configured for receipt and retention of a lighting element 18, for example a light emitting diode (LED) lighting strip. The lighting element 18 may preferably likewise be bendable in the same manner as the bendable lighting fixture 10.

The bendable lighting fixture 10 may also include a spacer lens 20 that is configured for positioning over the lighting element 18 to allow for adjustment of the lighting characteristics of the light emitted from the lighting element 18. For example, the material used for the spacer lens 20, the thickness and/or height of the spacer lens 20 from the lighting element 18 are examples of possible adjustments that can be made to affect the light characteristics, e.g. color, hue, brightness, warmth, etc., of the light perceived as being emitted from the bendable lighting fixture 10. The spacer lens 20 may be made from a suitably flexible and/or bendable translucent or transparent material. It is understood that the spacer lens 20 may also be colored, tinted and/or dyed as another means of affecting the light characteristics of the light ultimately emitted from the bendable lighting fixture 10.

Figure 1C:
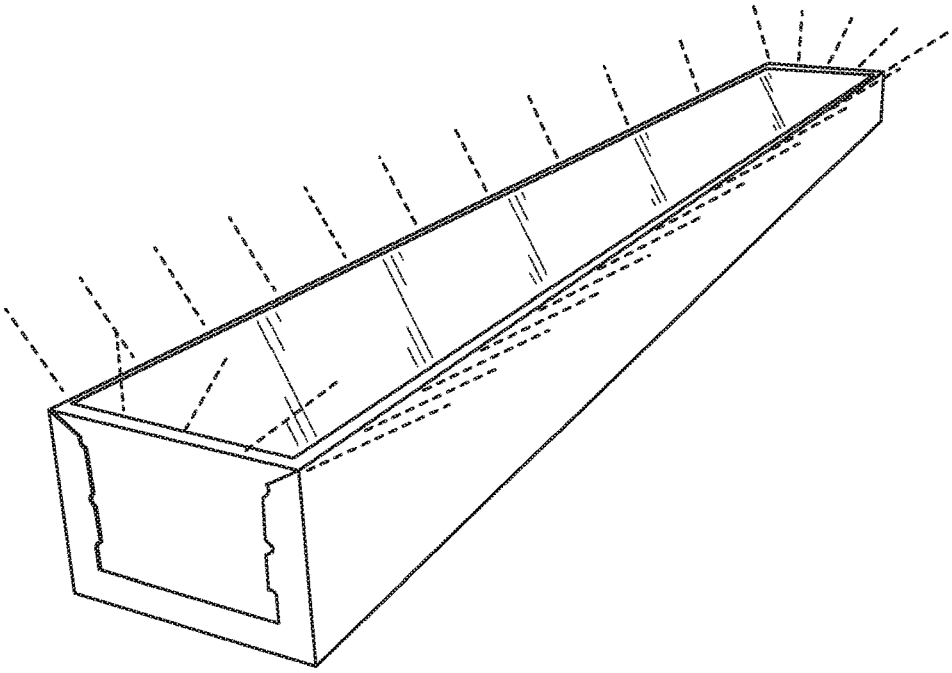
FIG. 1C is an isometric view of the exemplary bendable lighting fixture shown in FIG. 1 with a translucent filling material.
Figure 1D:
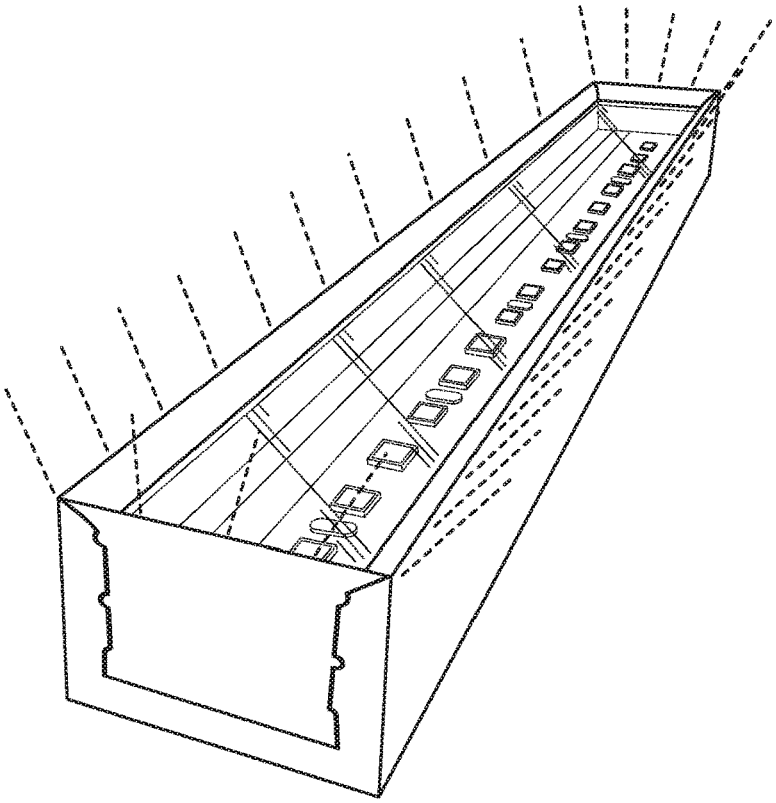
FIG. 1D is an isometric view of the exemplary bendable lighting fixture shown in FIG. 1 with a transparent filling material.
Figure 2:
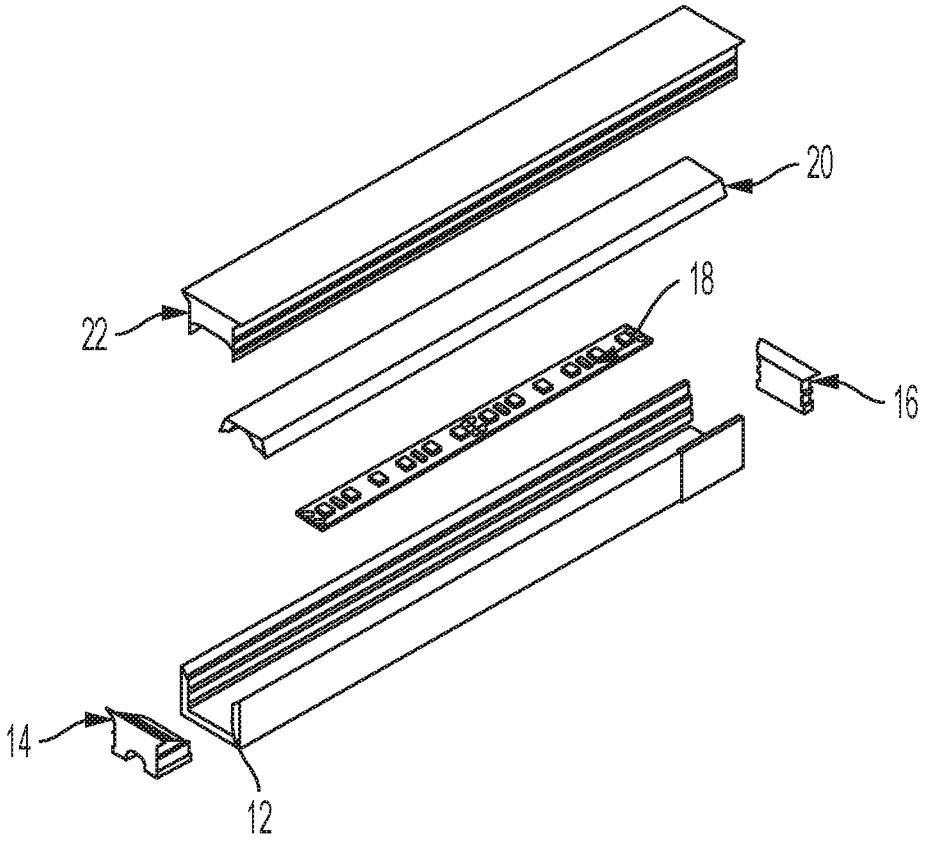
FIG. 2 is an exploded view of the exemplary bendable lighting fixture shown in FIG. 1.
Figure 3:
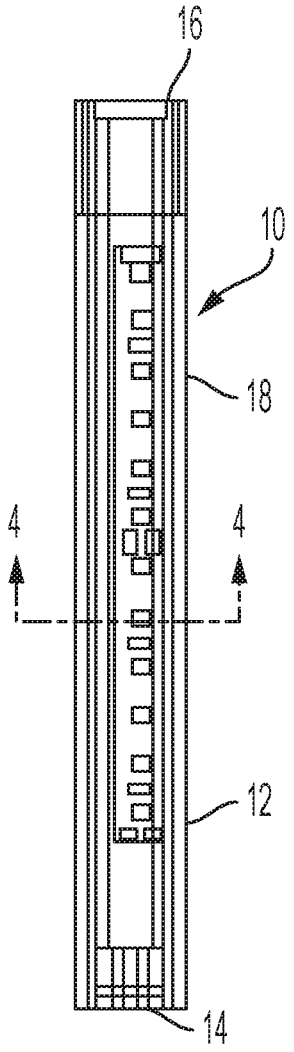
FIG. 3 is a top plan view of the exemplary bendable lighting fixture shown in FIG. 1.
Figure 4:
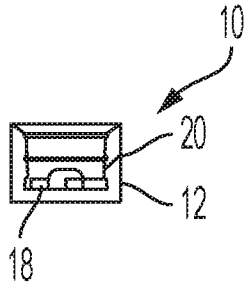
FIG. 4 is a cross-sectional view of the exemplary bendable lighting fixture taken along line 4-4 in FIG. 3.
Figure 4A:
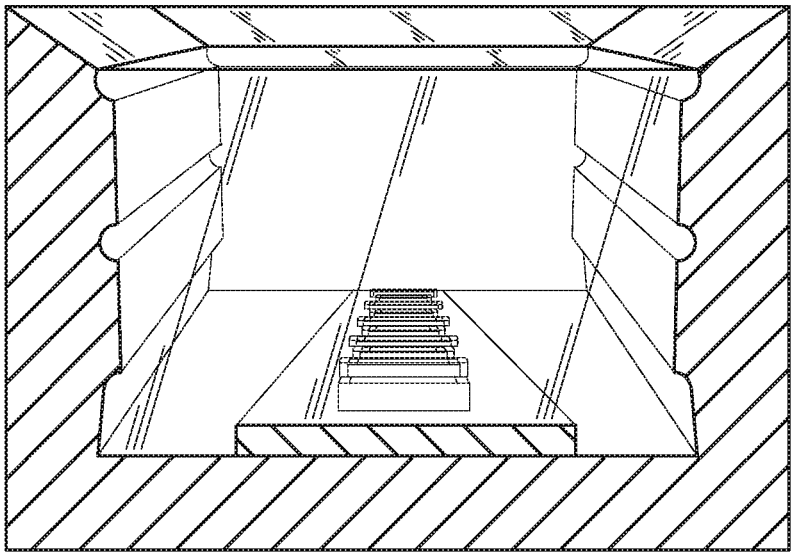
FIG. 4A is a cross-sectional view of the exemplary bendable lighting fixture taken along line 4-4 in FIG. 3.
Figure 5:
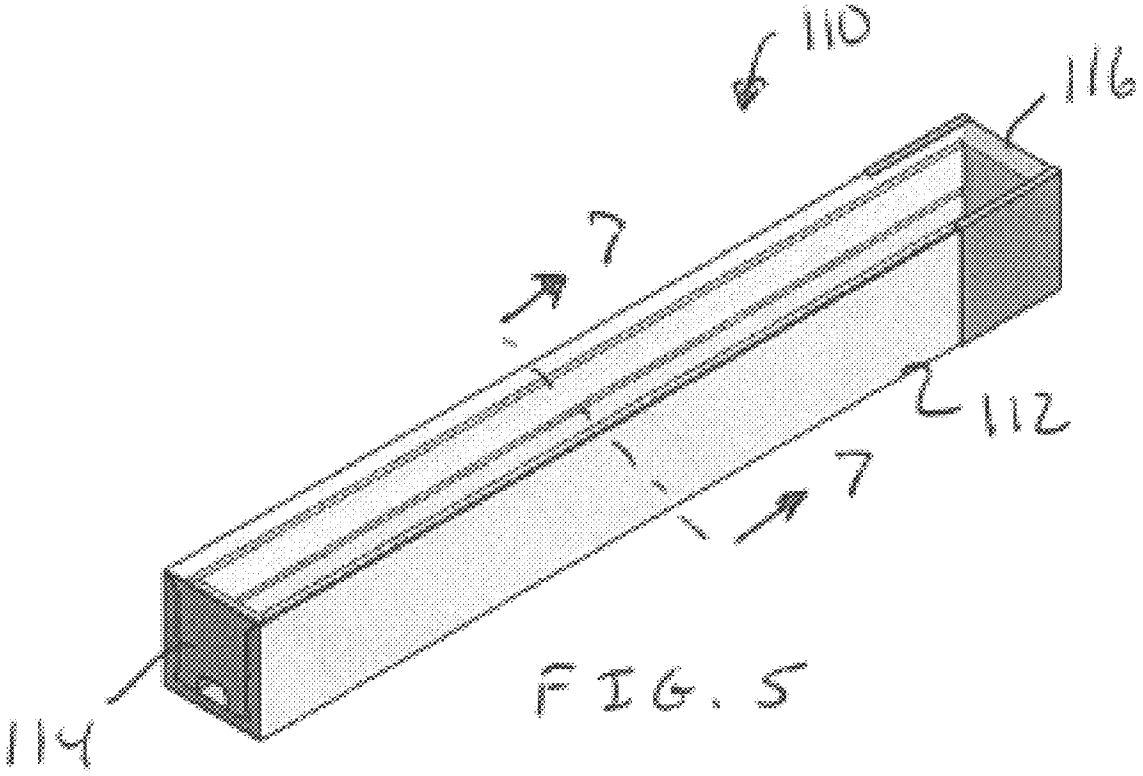
FIG. 5 is an isometric view of an exemplary bendable lighting fixture according to an exemplary embodiment of the present invention.
Figure 5A:
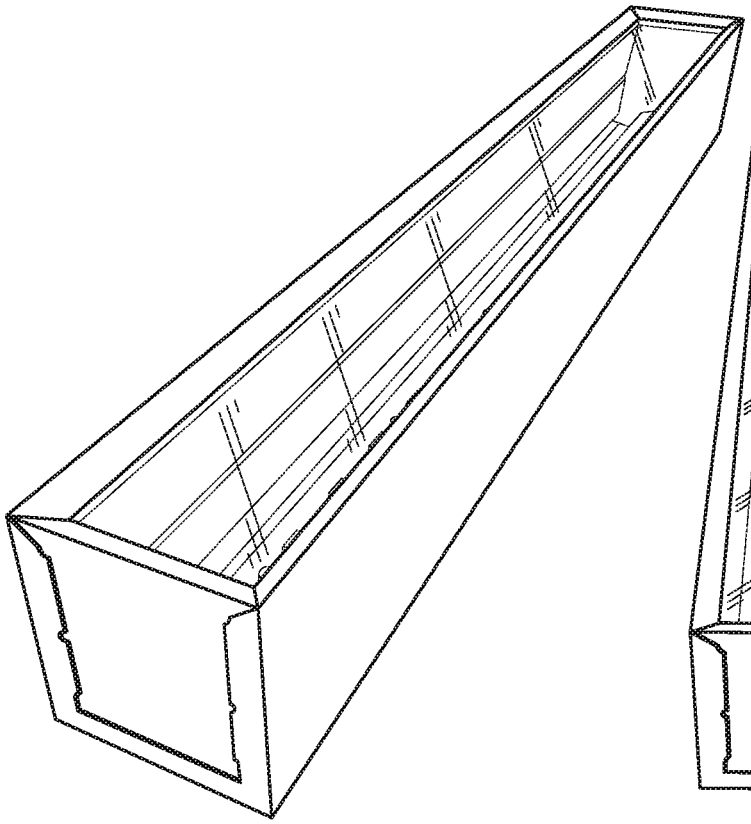
FIG. 5A is an isometric view of the exemplary bendable lighting fixture shown in FIG. 5.
Figure 5B:
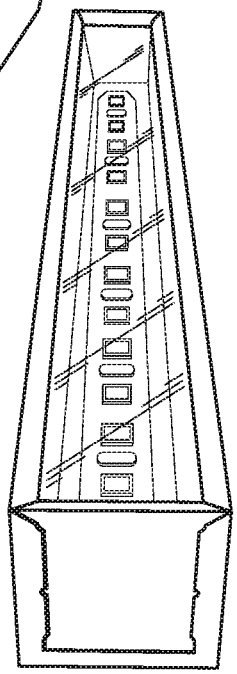
FIG. 5B is an isometric view of the exemplary bendable lighting fixture shown in FIG. 5.
Figure 5C:
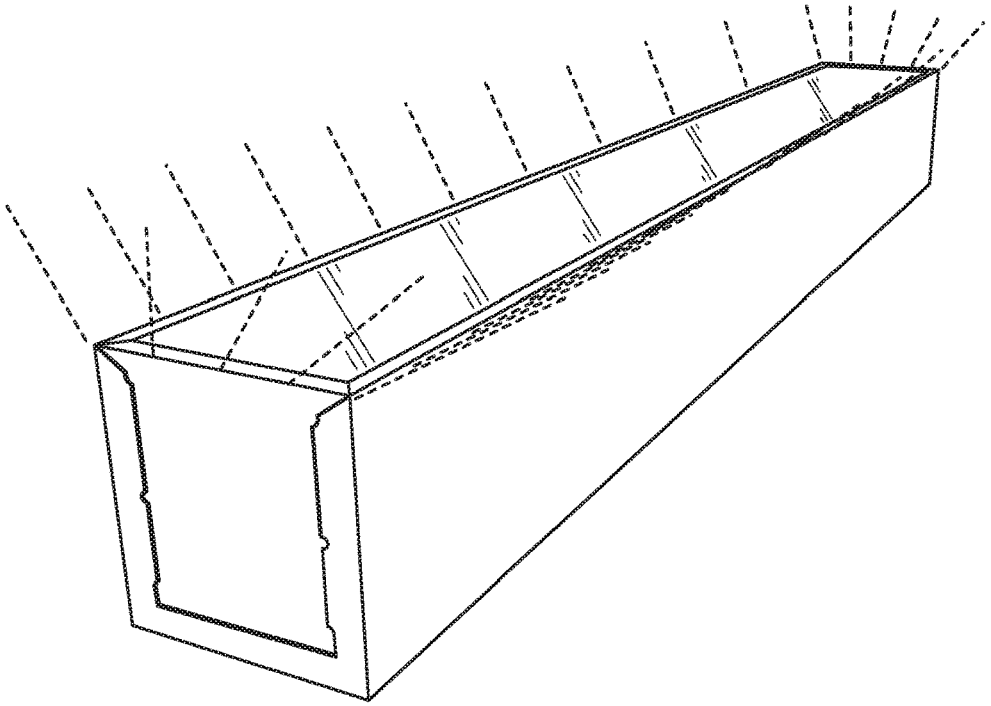
FIG. 5C is an isometric view of the exemplary bendable lighting fixture shown in FIG. 5 with a translucent filling material.
Figure 5D:
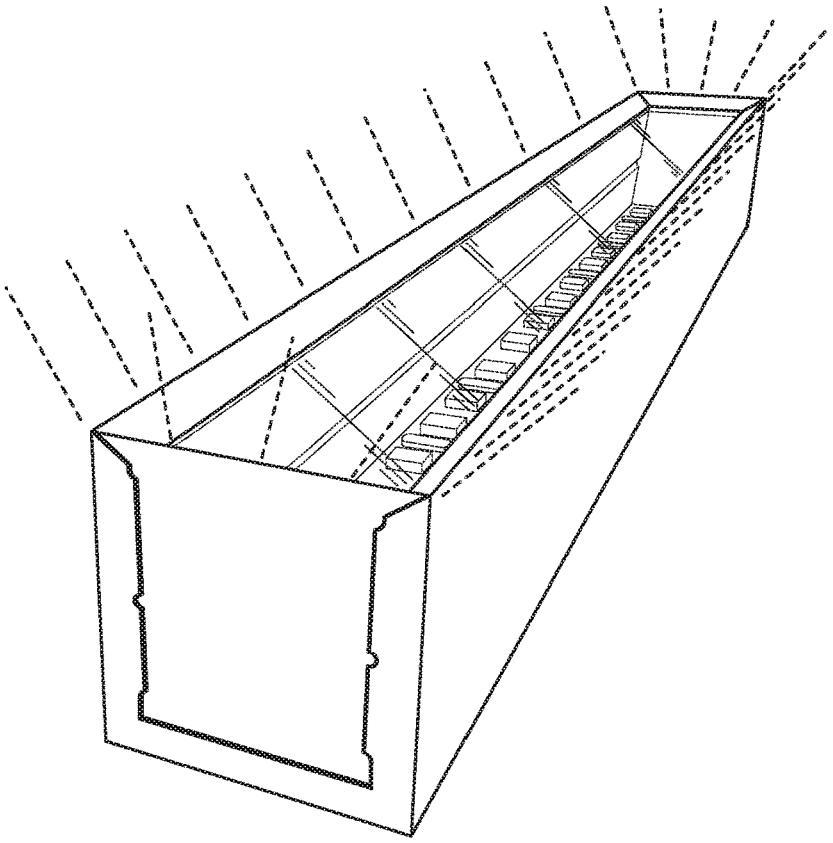
FIG. 5D is an isometric view of the exemplary bendable lighting fixture shown in FIG. 5 with a transparent filling material.
Figure 6:
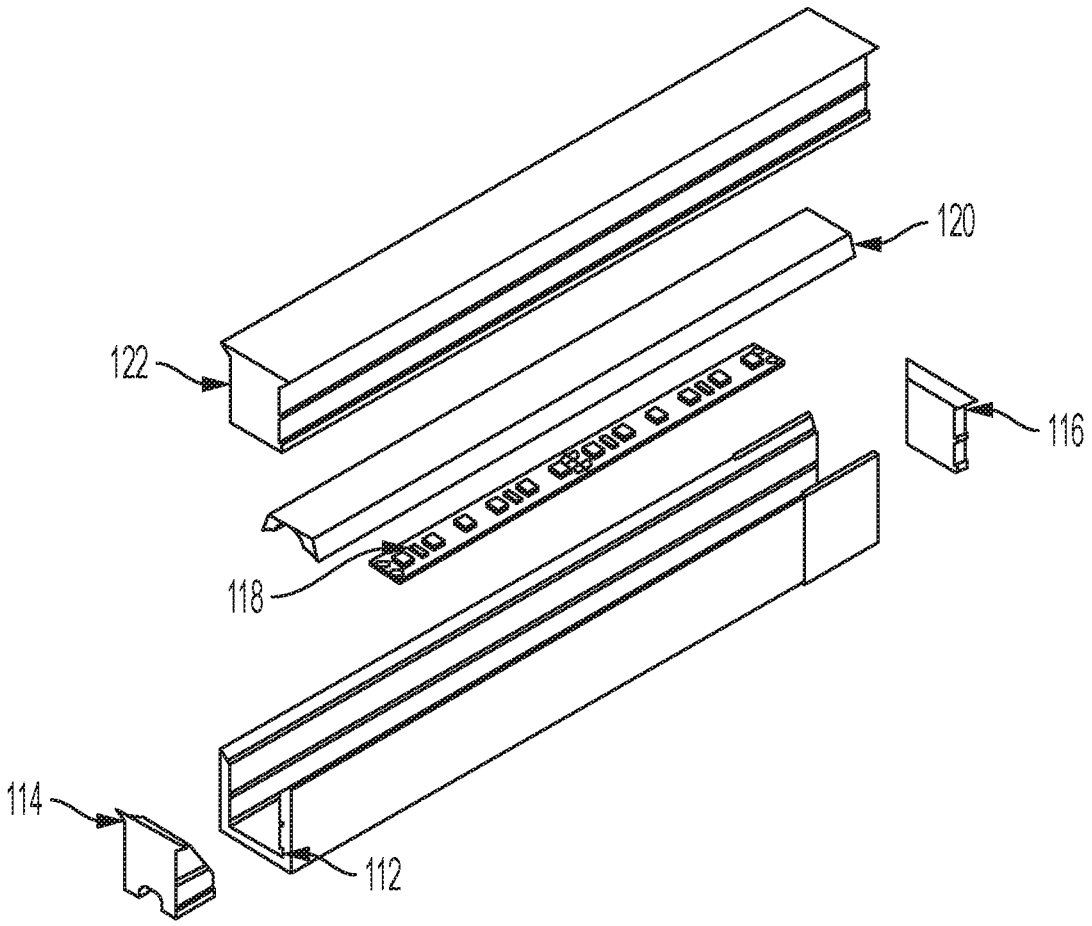
FIG. 6 is an exploded view of the exemplary bendable lighting fixture shown in FIG. 5.
Figure 7A:
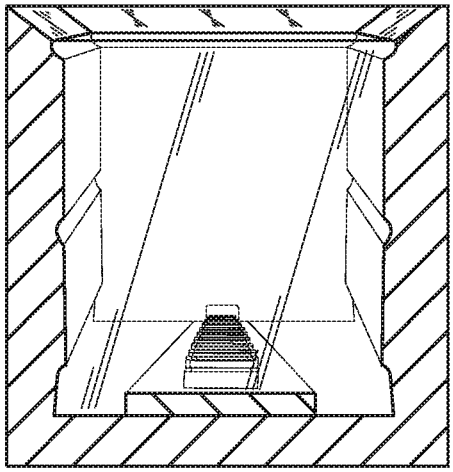
FIG. 7A is a cross-sectional view of the exemplary bendable lighting fixture taken along line 7-7 in FIG. 5.
Figure 7:
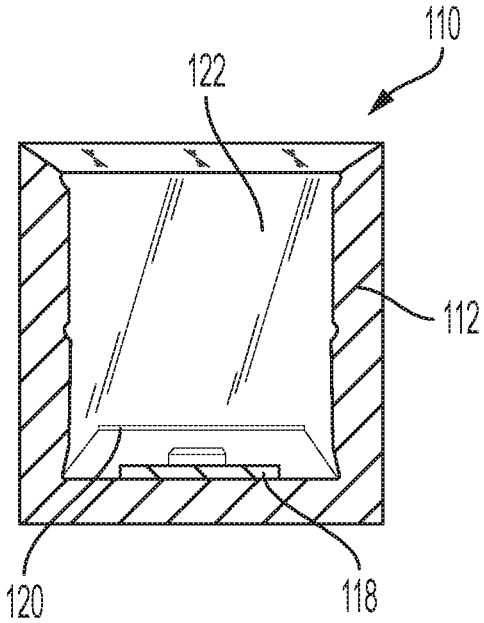
FIG. 7 is a cross-sectional view of the exemplary bendable lighting fixture taken along line 7-7 in FIG. 5.

The bendable lighting fixture 10 may also include a filling material 22, for example a polyurethane filling, that produces a substantially flat surface for the bendable lighting fixture 10, so that the bendable lighting fixture 10 may be suitable for use in traveled surfaces, such as walkways, driveways and the like. The filling material 22 is likewise flexible and/or bendable so that it is configured to flex, bend and/or twist along with the profile 12 in order to allow the bendable lighting fixture 10 to be flexed, bent and/or twisted in at least one direction relative to the longitudinal axis of the bendable lighting fixture 10. In this manner, the bendable lighting fixture 10 may be contoured to the surface on which it may be mounted. The filling material 22 may be a transparent (see e.g. FIGS. 1A, 1B and 1D) or translucent material (see e.g. FIG. 1C), and may be colored, tinted and/or dyed to affect the light characteristics of the light emitted from the bendable lighting fixture 10. As shown in FIG. 1C, if a translucent filing material 22 is used, the filling material 22 may act to obscure the individual light emitting elements of the lighting element 18, for example individual LEDs, when the lighting element 18 is illuminated. In this manner, the individual LEDs, for example, are not visible when the bendable lighting fixture 10 is illuminated. It is understood that the spacer lens 20 may also be made from a material, for example a translucent material, which also acts to obscure the individual light emitting elements when the lighting element 18 is illuminated. The filling material 22 may be poured into the profile 12, and then cured and/or solidified to produce a substantially solid lens for the bendable lighting fixture 10.

Figure 14:
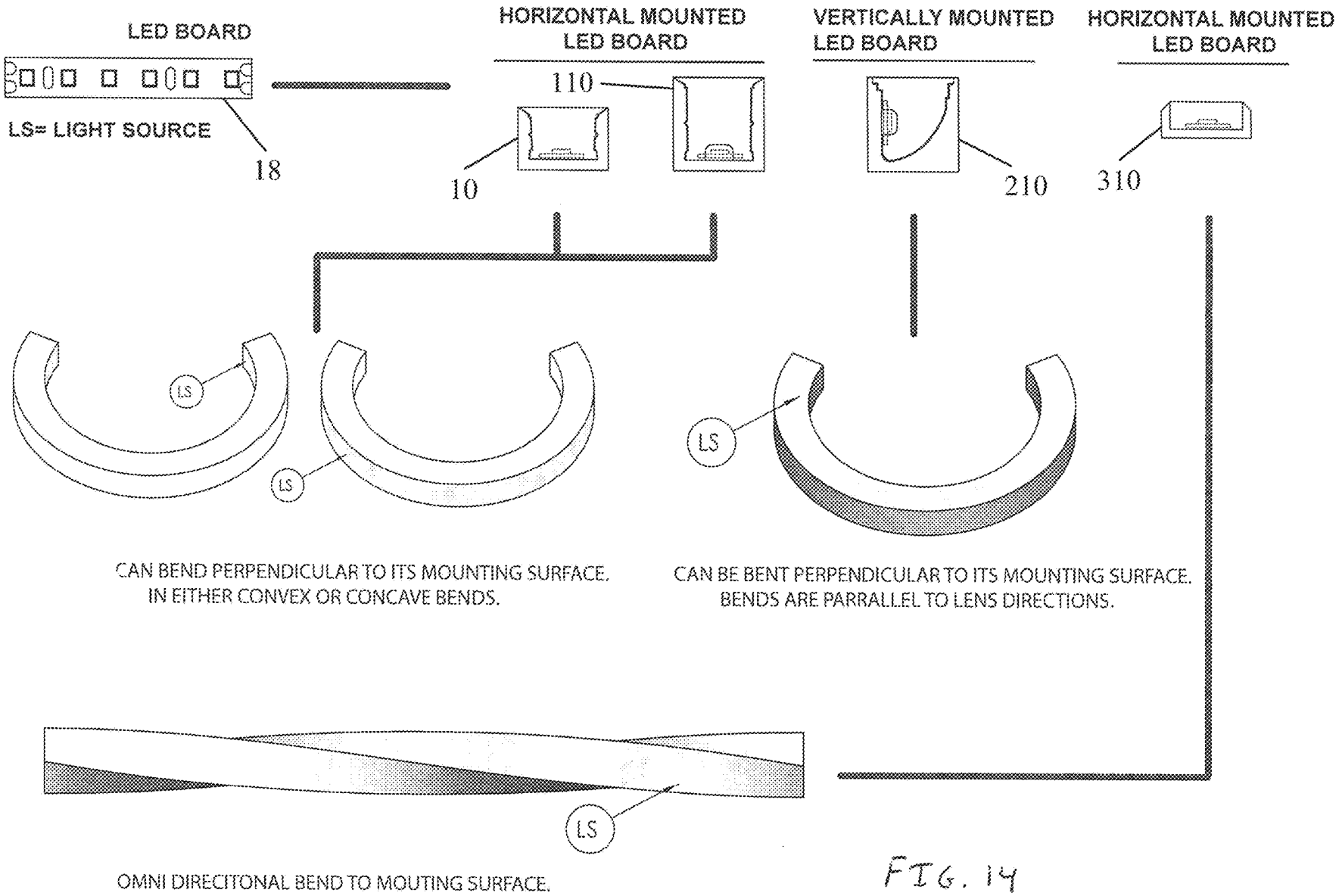
FIG. 14 is a diagram showing exemplary configurations of the exemplary bendable lighting fixture embodiments according to the present invention.
Figure 15:
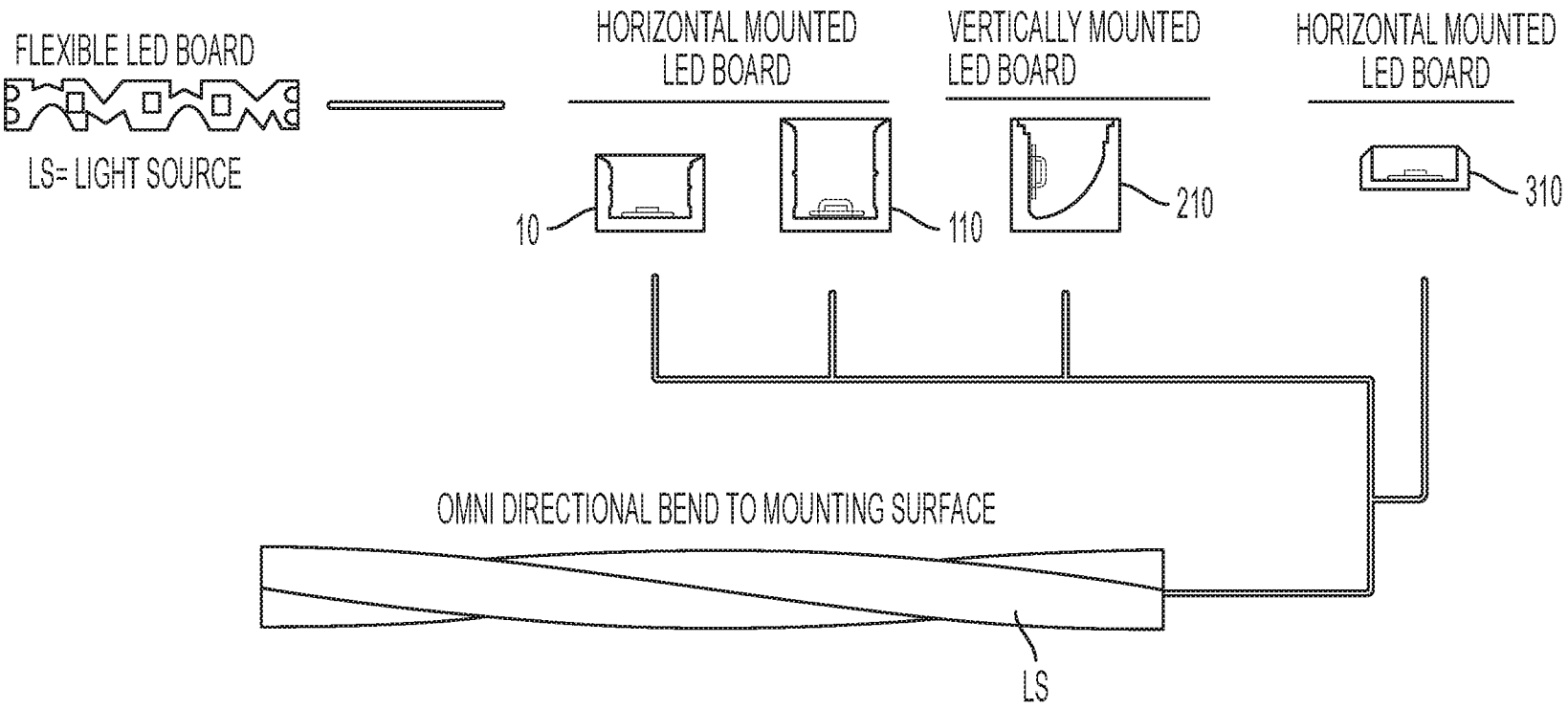
FIG. 15 is a diagram showing exemplary configurations of the exemplary bendable lighting fixture embodiments according to the present invention.
Figures 20, 21, 22, 23:
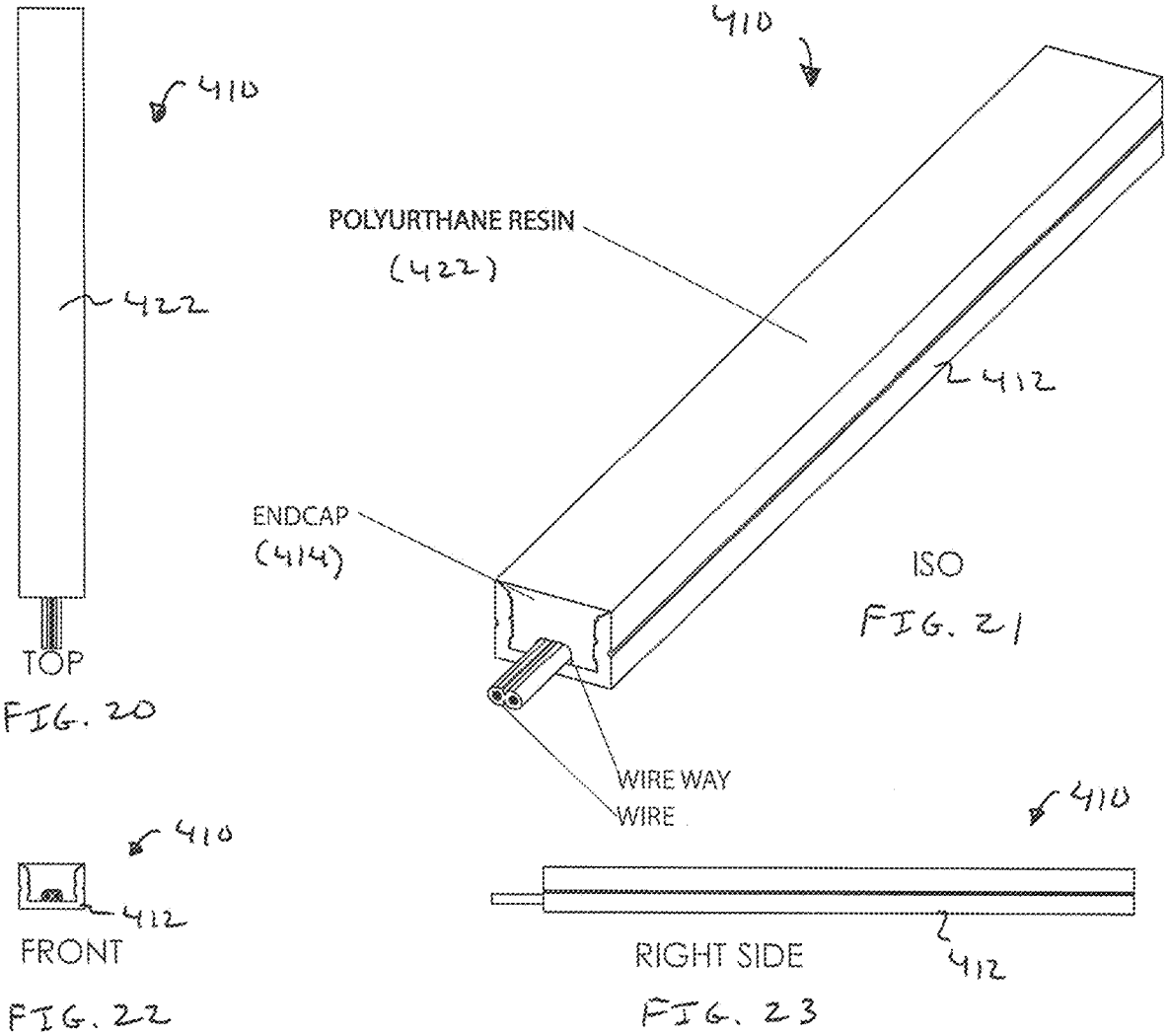
FIG. 20 is a top plan view of the exemplary bendable lighting fixture shown in FIG. 21.
FIG. 21 is an isometric view of the exemplary bendable lighting fixture.
FIG. 22 is front view of the exemplary bendable lighting fixture shown in FIG. 21.
FIG. 23 is side view of the exemplary bendable lighting fixture shown in FIG. 21.
Figure 39:
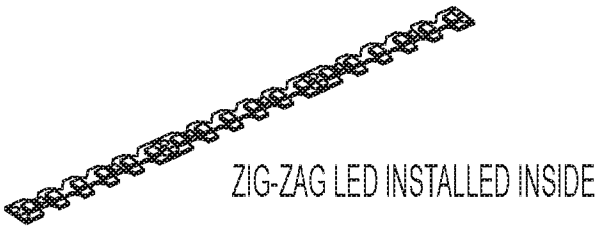
FIG. 39 is an isometric view of an exemplary lighting element that may be used with the exemplary bendable lighting fixtures according to the present invention.

The lighting element 18 may be a standard LED board, as shown for example in FIG. 14, and in that case the bendable lighting fixture 10 would be configured to bend and flex as shown in the examples illustrated in FIG. 14. The examples illustrated in FIG. 14 demonstrate that the bendable lighting fixture 10 may be configured to bend along a surface on which the bendable lighting fixture 10 may be mounted in either a convex or concave direction. In this manner, the bendable lighting fixture 10 may be configured to bend and/or flex as shown in the examples illustrated in FIG. 14 in order to contour to the surface on which the bendable lighting fixture 10 may be mounted. It is understood that the bendable lighting fixture 10 is not limited to the exemplary bending and/or flexing configurations shown in FIG. 14, and a significant number of other bending and/or flexing configuration are possible according to aspects of the present invention, including, but not limited to those configurations shown in FIGS. 40A-40E. In this manner, the bendable lighting fixture 10 may be installed on a variety of differently contoured surfaces due to the flexible nature of the bendable lighting fixture 10. Optionally, the lighting element may be a flexible LED board, as shown for example in FIGS. 15 and 39, and in that case the bendable lighting fixture 10 would be configured to bend and flex as shown in FIG. 15 to provide for omnidirectional bending of the bendable lighting fixture 10 relative to a surface on which the bendable lighting fixture 10 may be mounted. The bendable lighting fixture 10 may be suitable for indoor and outdoor lighting applications, and may be configured to be water resistant or waterproof thereby allowing for use of the bendable lighting fixture 10 in locations exposed to moisture and/or the elements. Such applications in which the bendable lighting fixture 10 may be exposed to moisture and/or the elements may include, but are not limited to, walkway surfaces, driveway surfaces and underwater lighting surfaces, such as pool or aquarium locations. It is understood that the water resistance, and or water proofing, of the bendable lighting fixture 10 may be provided at least in part by the filling material 22 creating at least a substantially watertight seal with the profile 12.

Referring now to FIGS. 5, 5A-5D, 6-7 and 7A, therein illustrated is an exemplary embodiment of a bendable lighting fixture, generally indicated by reference numeral 110, according to an exemplary aspect of the present invention. The bendable lighting fixture 110 may include a profile 112, which may be made from a flexible material, such as a flexible plastic, rubber, thermoplastic material, polymer or ceramic. Constructing the profile 112 of a flexible material allows the profile 112 to be bent, flexed and/or twisted in at least one direction relative to the longitudinal axis of the profile 112. The profile 112 of the bendable lighting fixture 110 may include one or more end caps 114, 116 that are configured and dimensioned to be positioned and removably secured at one or more of the ends of the profile 112. It is understood that the end caps 114, 116, although different in configuration, may be configured so that each end cap 114 or 116 may be positioned at each end of the profile 112. One or both end caps 114, 116 may include an opening formed therein to provide a passage for wires to extend from the interior of the bendable lighting fixture 110 to the exterior of the bendable lighting fixture 110. The bendable lighting fixture 110 may be configured for receipt and retention of a lighting element 118, for example a light emitting diode (LED) lighting strip. The lighting element 118 may preferably likewise be bendable in the same manner as the bendable lighting fixture 110. It is understood that the lighting element 118 may be the same or substantially the same as the lighting element 18 discussed above with respect to the bendable lighting fixture 10. In other words, it is understood that lighting elements 18 and 118 may be substantially interchangeable.

The bendable lighting fixture 110 may also include a spacer lens 120 that is configured for positioning over the lighting element 118 to allow for adjustment of the lighting characteristics of the light emitted from the lighting element 118. For example, the material used for the spacer lens 120, the thickness and/or height of the spacer lens 120 from the lighting element 118 are examples of possible adjustments that can be made to affect the light characteristics, e.g. color, hue, brightness, warmth, etc., of the light perceived as being emitted from the bendable lighting fixture 110. The spacer lens 120 may be made from a suitably flexible and/or bendable translucent or transparent material. It is understood that the spacer lens 120 may also be colored, tinted and/or dyed as another means of affecting the light characteristics of the light ultimately emitted from the bendable lighting fixture 110. The bendable lighting fixture 110 may also include a filling material 122, for example a polyurethane filling, that produces a substantially flat surface for the bendable lighting fixture 110, so that the bendable lighting fixture 110 may be suitable for use in traveled surfaces, such as walkways, driveways and the like. The filling material 122 is likewise flexible and/or bendable so that it is configured to flex and/or bend along with the bendable lighting fixture 110. In this manner, the bendable lighting fixture 110 may be contoured to the surface on which it may be mounted. The filling material 122 may be a transparent (see e.g. FIGS. 5A, 5B and 5D) or translucent (see e.g. FIG. 5C) material, and may be colored, tinted or dyed to affect the light characteristics of the light emitted from the bendable lighting fixture 110. As shown in FIG. 1C, if a translucent filing material 122 is used, the filling material 122 may act to obscure the individual light emitting elements of the lighting element 118, for example individual LEDs, when the lighting element 118 is illuminated. In this manner, the individual LEDs, for example, are not visible when the bendable lighting fixture 110 is illuminated. It is understood that the spacer lens 120 may also be made from a material, for example a translucent material, which also acts to obscure the individual light emitting elements when the lighting element 118 is illuminated. The filling material 122 may be poured into the profile 112, and then cured and/or solidified to produce a substantially solid lens for the bendable lighting fixture 110.

The lighting element 118 may be a standard LED board, as shown for example in FIG. 14, and in that case the bendable lighting fixture 110 would be configured to bend and flex as shown in the examples illustrated in FIG. 14. The examples illustrated in FIG. 14 demonstrate that the bendable lighting fixture 110 may be configured to bend along a surface on which the bendable lighting fixture 110 may be mounted in either a convex or concave direction. In this manner, the bendable lighting fixture 110 may be configured to bend and/or flex as shown in the examples illustrated in FIG. 14 in order to contour to the surface on which the bendable lighting fixture 110 may be mounted. It is understood that the bendable lighting fixture 110 is not limited to the exemplary bending and/or flexing configurations shown in FIG. 14, and a significant number of other bending and/or flexing configuration are possible according to aspects of the present invention, including, but not limited to those configurations shown in FIGS. 40A-40E. In this manner, the bendable lighting fixture 110 may be installed on a variety of differently contoured surfaces due to the flexible nature of the bendable lighting fixture 110. Optionally, the lighting element may be a flexible LED board, as shown for example in FIGS. 15 and 39, and in that case the bendable lighting fixture 110 would be configured to bend and flex as shown in FIG. 15 to provide for omnidirectional bending of the bendable lighting fixture 110 relative to a surface on which the bendable lighting fixture 110 may be mounted. The bendable lighting fixture 110 may be suitable for indoor and outdoor lighting applications, and may be configured to be water resistant or waterproof thereby allowing for use of the bendable lighting fixture 110 in locations exposed to moisture and/or the elements. Such applications in which the bendable lighting fixture 110 may be exposed to moisture and/or the elements may include, but are not limited to, walkway surfaces, driveway surfaces and underwater lighting surfaces, such as pool or aquarium locations. It is understood that the water resistance, and or water proofing, of the bendable lighting fixture 110 may be provided at least in part by the filling material 122 creating at least a substantially watertight seal with the profile 112.

Figure 10A:
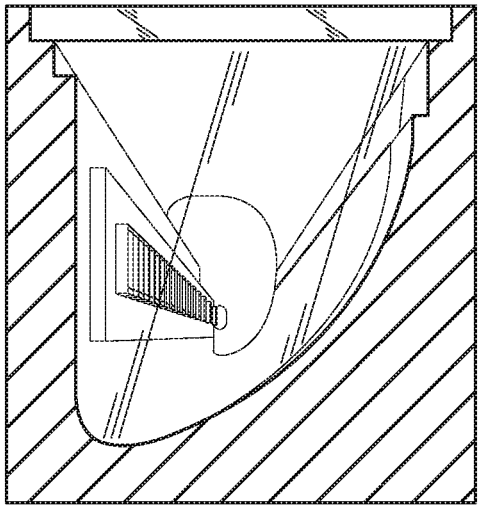
FIG. 10A is a cross-sectional view of the exemplary bendable lighting fixture taken along line 10-10 in FIG. 8 without the optional louvers.
Figure 10:
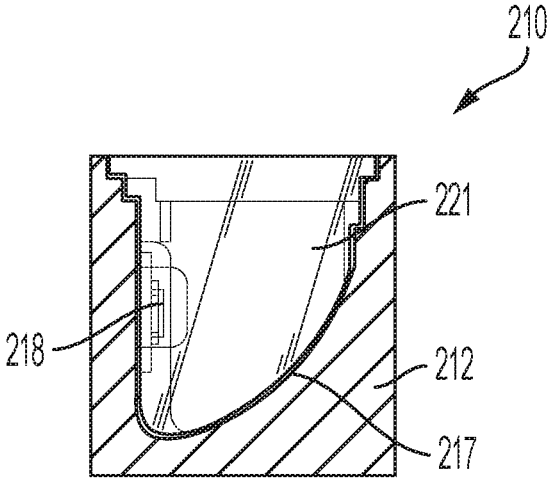
FIG. 10 is a cross-sectional view of the exemplary bendable lighting fixture taken along line 10-10 in FIG. 8.

Referring now to FIGS. 8, 8A-8D, 9-10 and 10A, therein illustrated is an exemplary embodiment of a bendable lighting fixture, generally indicated by reference numeral 210, according to an exemplary aspect of the present invention. The bendable lighting fixture 210 may include a profile 212, which may be made from a flexible material, such as a flexible plastic, rubber, thermoplastic material, polymer or ceramic. Constructing the profile 212 of a flexible material allows the profile 212 to be bent, flexed and/or twisted in at least one direction relative to the longitudinal axis of the profile 212. The profile 212 of the bendable lighting fixture 210 may include one or more end caps 214, 216 that are configured and dimensioned to be positioned and removably secured at one or more of the ends of the profile 212. It is understood that the end caps 214, 216, although different in configuration, may be configured so that each end cap 214 or 216 may be positioned at each end of the profile 212. One or both end caps 214, 216 may include an opening formed therein to provide a passage for wires to extend from the interior of the bendable lighting fixture 210 to the exterior of the bendable lighting fixture 210. The profile 212 of the bendable lighting fixture 210 may include a curved surface 217 positioned within the interior region of the profile 212. The curved surface 217 may be a substantially concave surface as shown in FIGS. 10 and 10A, but it is understood that the present invention is not limited to any particular configuration of the curved surface 217, and the curved surface may be convex or substantially slanted and still contemplated by the various aspects of the presented invention. The bendable lighting fixture 210 may be configured for receipt and retention of a lighting element 218, for example a light emitting diode (LED) lighting strip. The lighting element 218 may preferably likewise be bendable in the same manner as the bendable lighting fixture 210. It is understood that the lighting element 218 may be the same or substantially the same as the lighting elements 18 and 118 discussed above. In other words, it is understood that lighting elements 18, 118 and 218 may be substantially interchangeable. The curved surface 217 of the profile 212 may act redirect the light emitted from the lighting element 218 in order to produce lighting effects from the bendable lighting fixture 210 and/or obscure the individual dots of light that may be emitted from the lighting element 218, for example if the lighting element 218 is a LED lighting strip.

Figure 8:
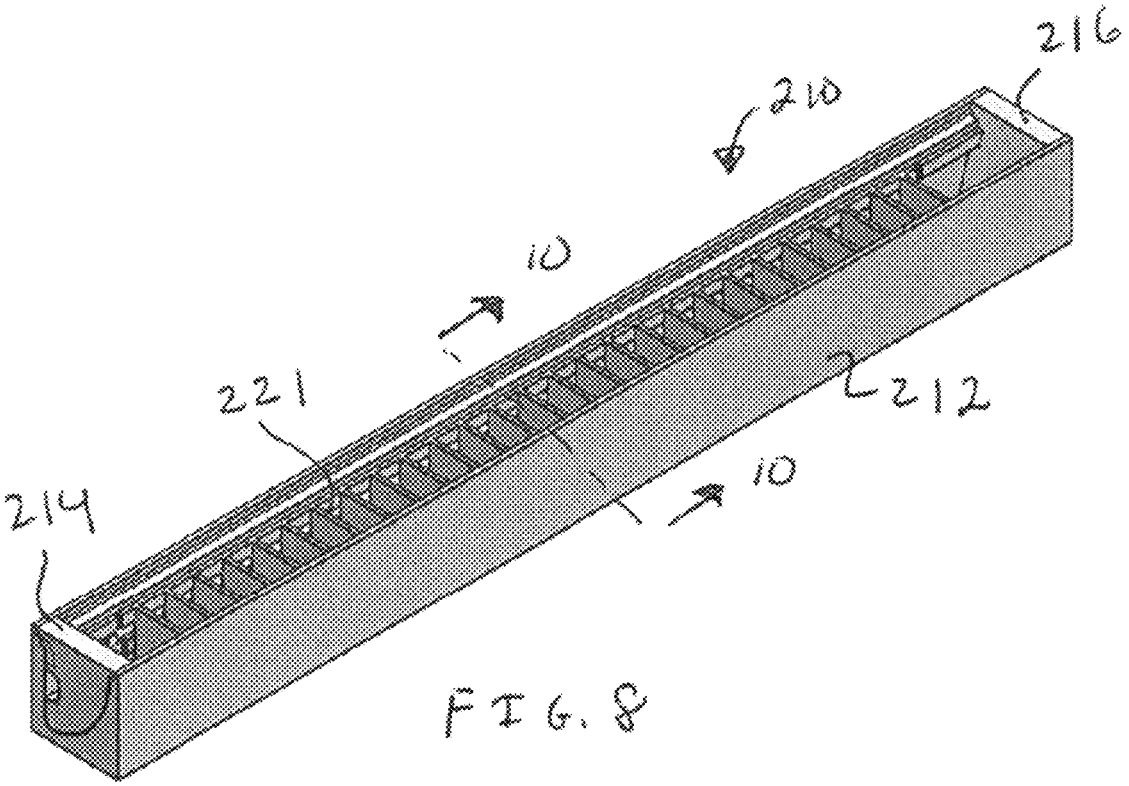
FIG. 8 is an isometric view of an exemplary bendable lighting fixture according to an exemplary embodiment of the present invention.
Figure 8A:
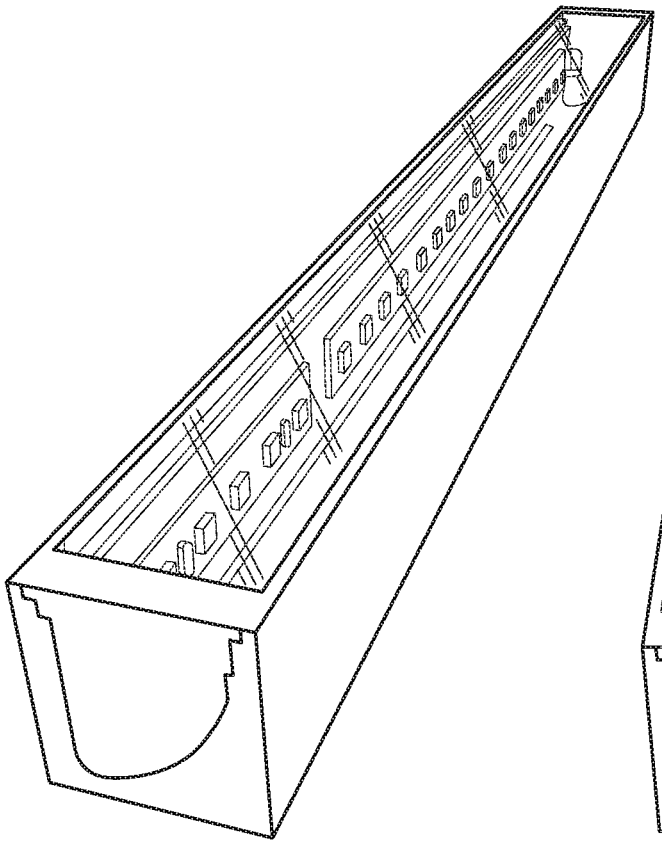
FIG. 8A is an isometric view of the exemplary bendable lighting fixture shown in FIG. 8 without the optional louvers.
Figure 8B:
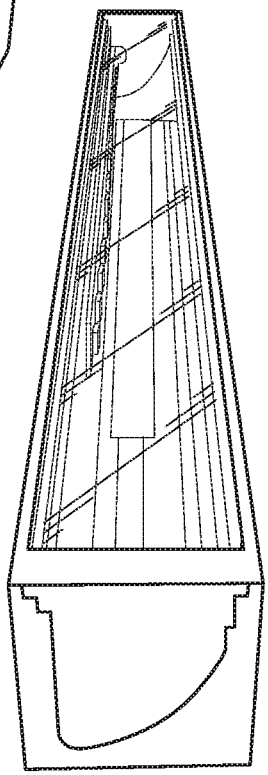
FIG. 8B is an isometric view of the exemplary bendable lighting fixture shown in FIG. 8 without the optional louvers.
Figure 8C:
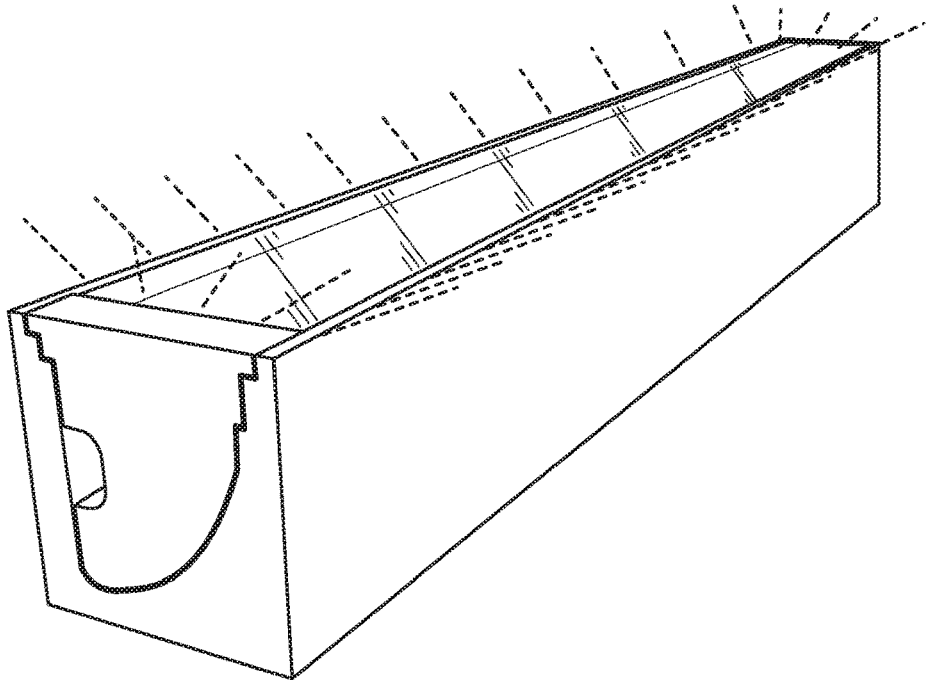
FIG. 8C is an isometric view of the exemplary bendable lighting fixture shown in FIG. 8 without the optional louvers and with a translucent filling material.
Figure 8D:
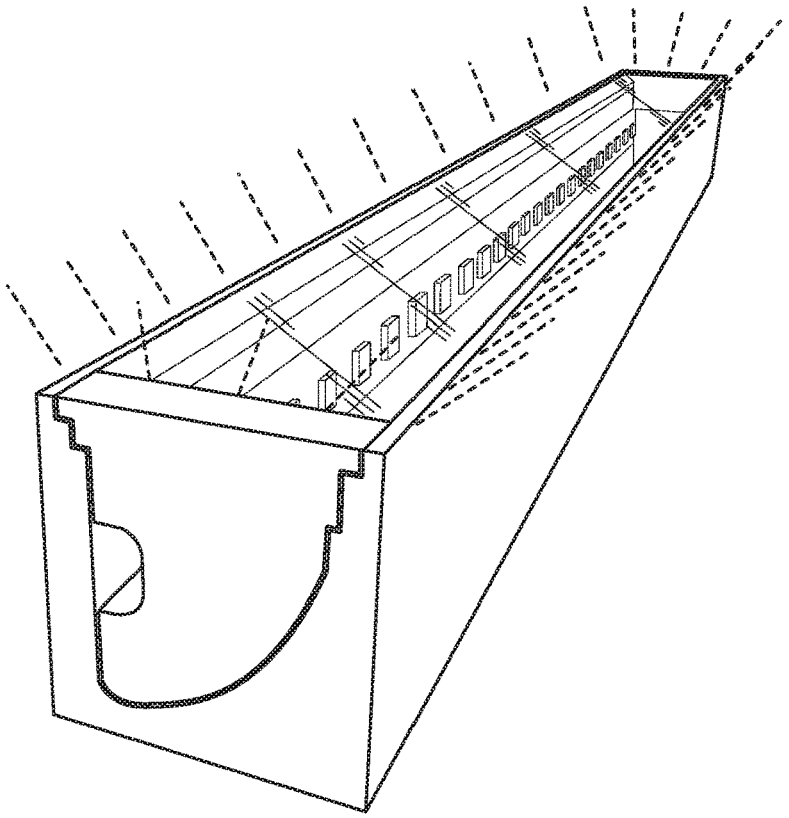
FIG. 8D is an isometric view of the exemplary bendable lighting fixture shown in FIG. 8 without the optional louvers and with a transparent filling material.
Figure 9:
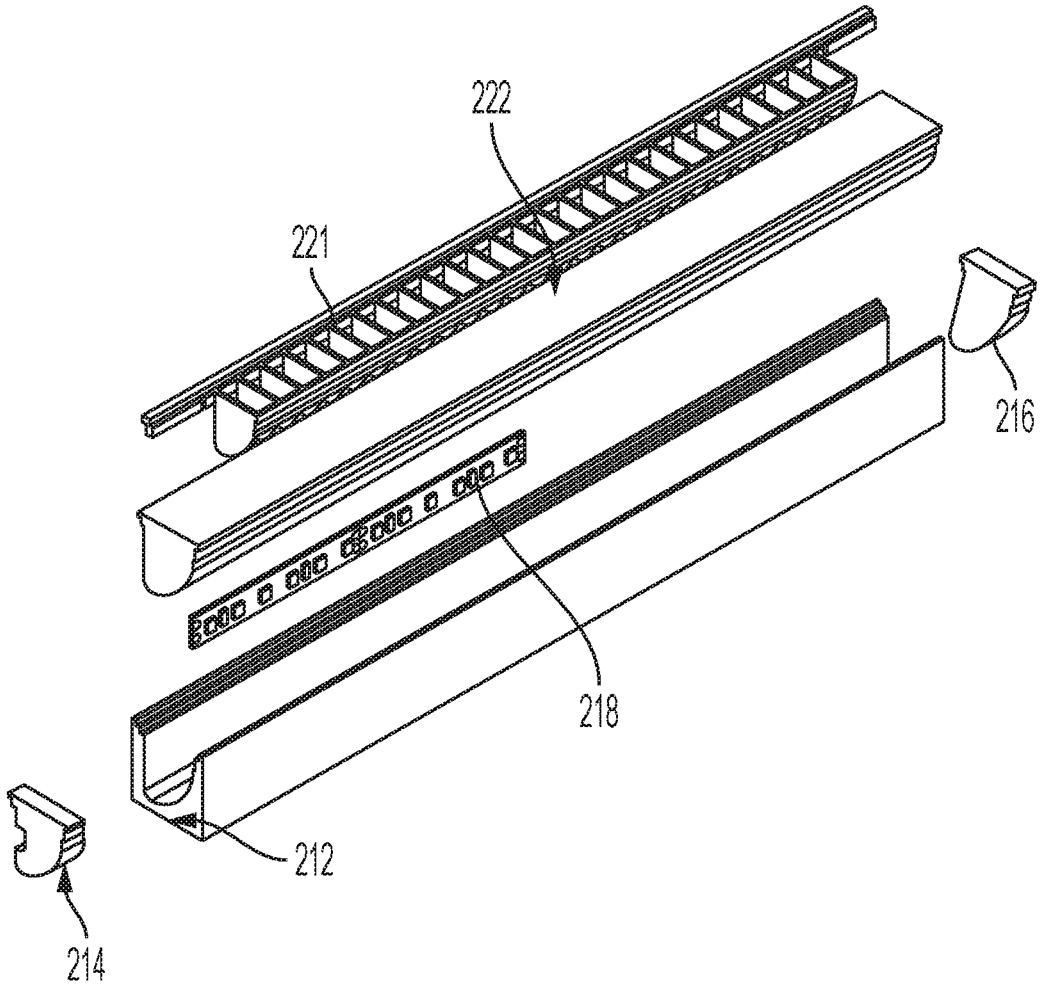
FIG. 9 is an exploded view of the exemplary bendable lighting fixture shown in FIG. 8.

The bendable lighting fixture 210 may also optionally include a louver 221 that is configured for positioning over the lighting element 218 to separate the individual light transmitting nodes of the lighting element 218. In this manner, the louver 221 is positioned so that light from the individual light transmitting nodes is directed in the desired direction from the bendable lighting fixture 210. The bendable lighting fixture 210 may also include a filling material 222, for example a polyurethane filling, that produces a substantially flat surface for the bendable lighting fixture 210, so that the bendable lighting fixture 210 may be suitable for use in traveled surfaces, such as walkways, driveways and the like. The filling material 222 is likewise flexible and/or bendable so that it is configured to flex and/or bend along with the bendable lighting fixture 210. The filling material 222 is likewise flexible and/or bendable so that it is configured to flex, bend and/or twist along with the profile 212 in order to allow the bendable lighting fixture 210 to be flexed, bent and/or twisted in at least one direction relative to the longitudinal axis of the bendable lighting fixture 210. In this manner, the bendable lighting fixture 210 may be contoured to the surface on which it may be mounted. The filling material 222 may be a transparent (see e.g. FIGS. 8A, 8B and 8D) or translucent (see e.g. FIG. 8C) material, and may be colored, tinted or dyed to affect the light characteristics of the light emitted from the bendable lighting fixture 210. As shown in FIG. 8C, if a translucent filing material 222 is used, the filling material 222 may act to obscure the individual light emitting elements of the lighting element 218, for example individual LEDs, when the lighting element 218 is illuminated. In this manner, the individual LEDs, for example, are not visible when the bendable lighting fixture 210 is illuminated. The filling material 222 may be poured into the profile 212, and then cured and/or solidified to produce a substantially solid lens for the bendable lighting fixture 210.

The lighting element 218 may be a standard LED board, as shown for example in FIG. 14, and in that case the bendable lighting fixture 210 would be configured to bend and flex as shown in the examples illustrated in FIG. 14. The examples illustrated in FIG. 14 demonstrate that the bendable lighting fixture 210 may be configured to bend along a surface on which the bendable lighting fixture 210 may be mounted so that the bends are parallel to the lighting element 218 direction. In this manner, the bendable lighting fixture 210 may be configured to bend and/or flex as shown in the examples illustrated in FIG. 14 in order to contour to the surface on which the bendable lighting fixture 210 may be mounted. It is understood that the bendable lighting fixture 210 is not limited to the exemplary bending and/or flexing configurations shown in FIG. 14, and a significant number of other bending and/or flexing configuration are possible according to aspects of the present invention, including, but not limited to those configurations shown in FIGS. 40A-40E. In this manner, the bendable lighting fixture 210 may be installed on a variety of differently contoured surfaces due to the flexible nature of the bendable lighting fixture 210. Optionally, the lighting element may be a flexible LED board, as shown for example in FIGS. 15 and 39, and in that case the bendable lighting fixture 210 would be configured to bend and flex as shown in FIG. 15 to provide for omnidirectional bending of the bendable lighting fixture 210 relative to a surface on which the bendable lighting fixture 210 may be mounted. The bendable lighting fixture 210 may be suitable for indoor and outdoor lighting applications, and may be configured to be water resistant or waterproof thereby allowing for use of the bendable lighting fixture 10 in locations exposed to moisture and/or the elements. Such applications in which the bendable lighting fixture 10 may be exposed to moisture and/or the elements may include, but are not limited to, walkway surfaces, driveway surfaces and underwater lighting surfaces, such as pool or aquarium locations. It is understood that the water resistance, and or water proofing, of the bendable lighting fixture 210 may be provided at least in part by the filling material 222 creating at least a substantially watertight seal with the profile 212.

Referring now to FIGS. 11, 11A-11D, 12-13 and 13A, therein illustrated is an exemplary embodiment of a bendable lighting fixture, generally indicated by reference numeral 310, according to an exemplary aspect of the present invention. The bendable lighting fixture 310 may include a profile 312, which may be made from a flexible material, such as a flexible plastic, rubber, thermoplastic material, polymer or ceramic. Constructing the profile 312 of a flexible material allows the profile 312 to be bent, flexed and/or twisted in at least one direction relative to the longitudinal axis of the profile 312. The profile 312 of the bendable lighting fixture 310 may include one or more end caps 314, 316 that are configured and dimensioned to be positioned and removably secured at one or more of the ends of the profile 312. It is understood that the end caps 314, 316, although different in configuration, may be configured so that each end cap 314 or 316 may be positioned at each end of the profile 312. One or both end caps 314, 316 may include an opening formed therein to provide a passage for wires to extend from the interior of the bendable lighting fixture 310 to the exterior of the bendable lighting fixture 310. The bendable lighting fixture 310 may be configured for receipt and retention of a lighting element 318, for example a light emitting diode (LED) lighting strip. The lighting element 318 may preferably likewise be bendable in the same manner as the bendable lighting fixture 310. It is understood that the lighting element 318 may be the same or substantially the same as lighting elements 18, 118 and/or 218 discussed above. In other words, it is understood that lighting elements 18, 118, 218 and 318 may be substantially interchangeable.

Figure 11:
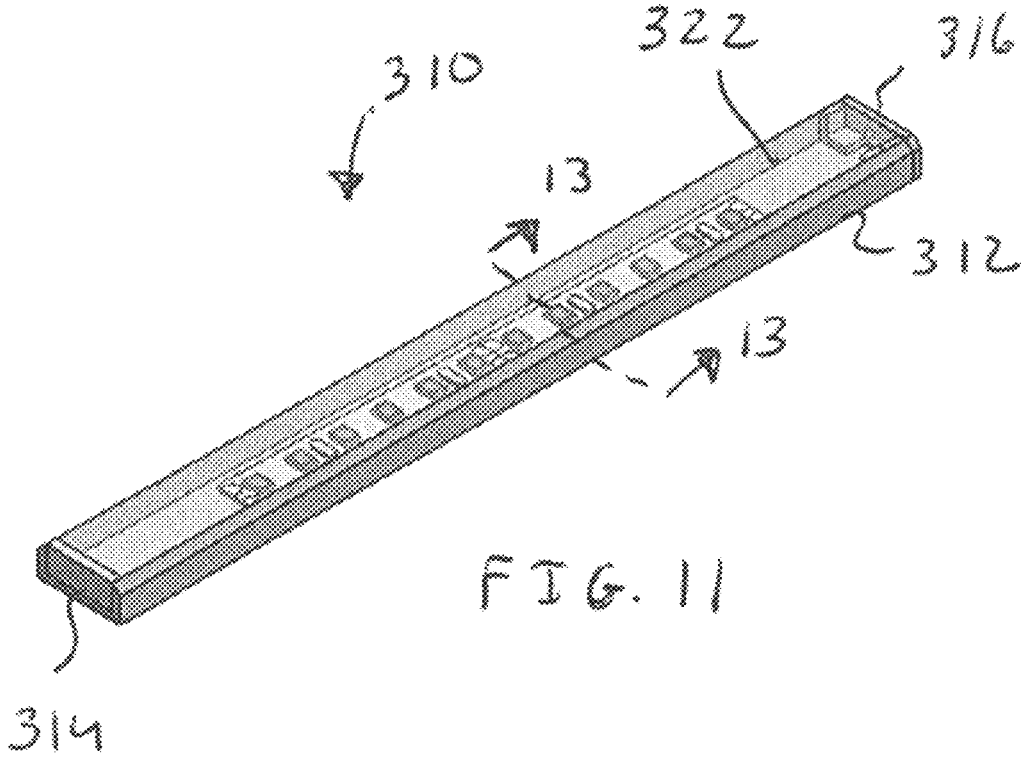
FIG. 11 is an isometric view of an exemplary bendable lighting fixture according to an exemplary embodiment of the present invention.
Figure 11A:
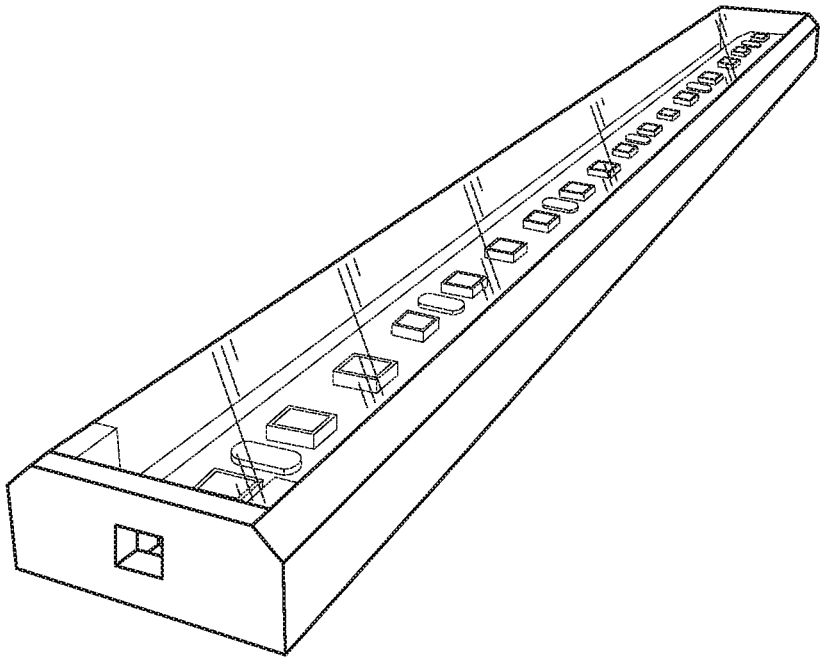
FIG. 11A is an isometric view of the exemplary bendable lighting fixture shown in FIG. 11.
Figure 11B:
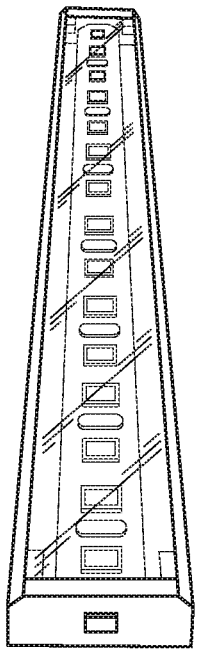
FIG. 11B is an isometric view of the exemplary bendable lighting fixture shown in FIG. 11.
Figures 11C, 11D:
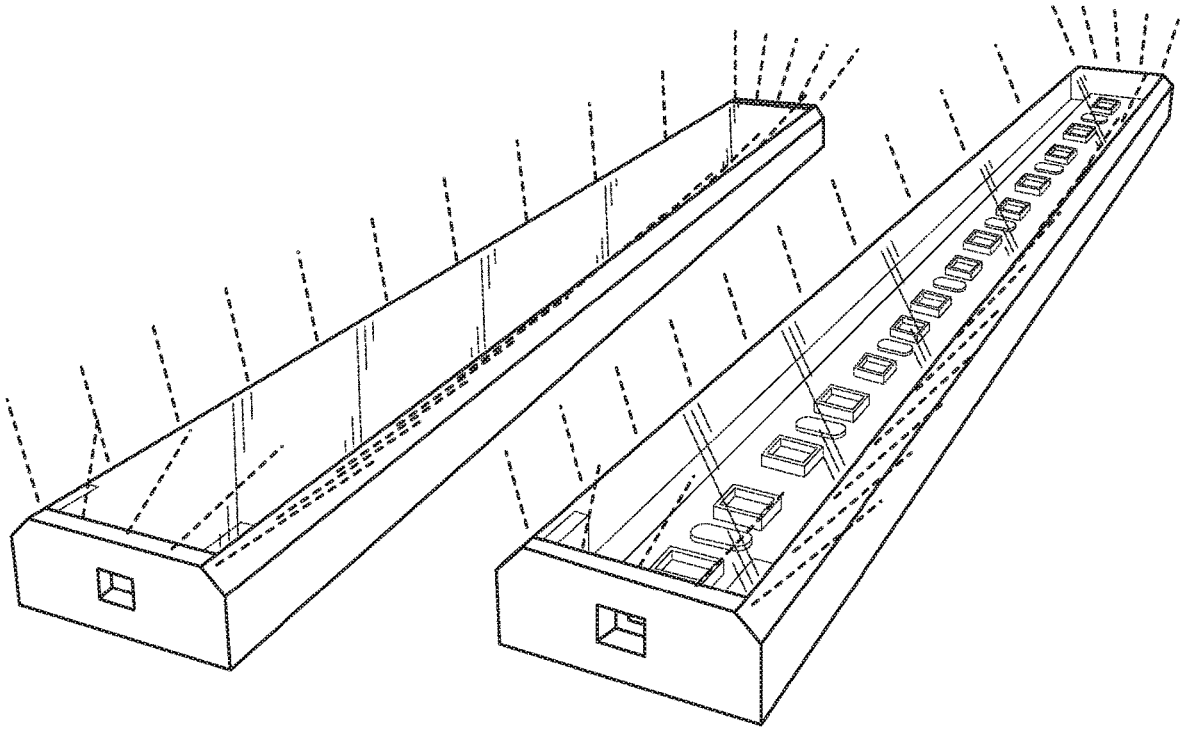
FIG. 11C is an isometric view of the exemplary bendable lighting fixture shown in FIG. 11 with a translucent filling material.
FIG. 11D is an isometric view of the exemplary bendable lighting fixture shown in FIG. 11 with a transparent filling material.
Figure 12:
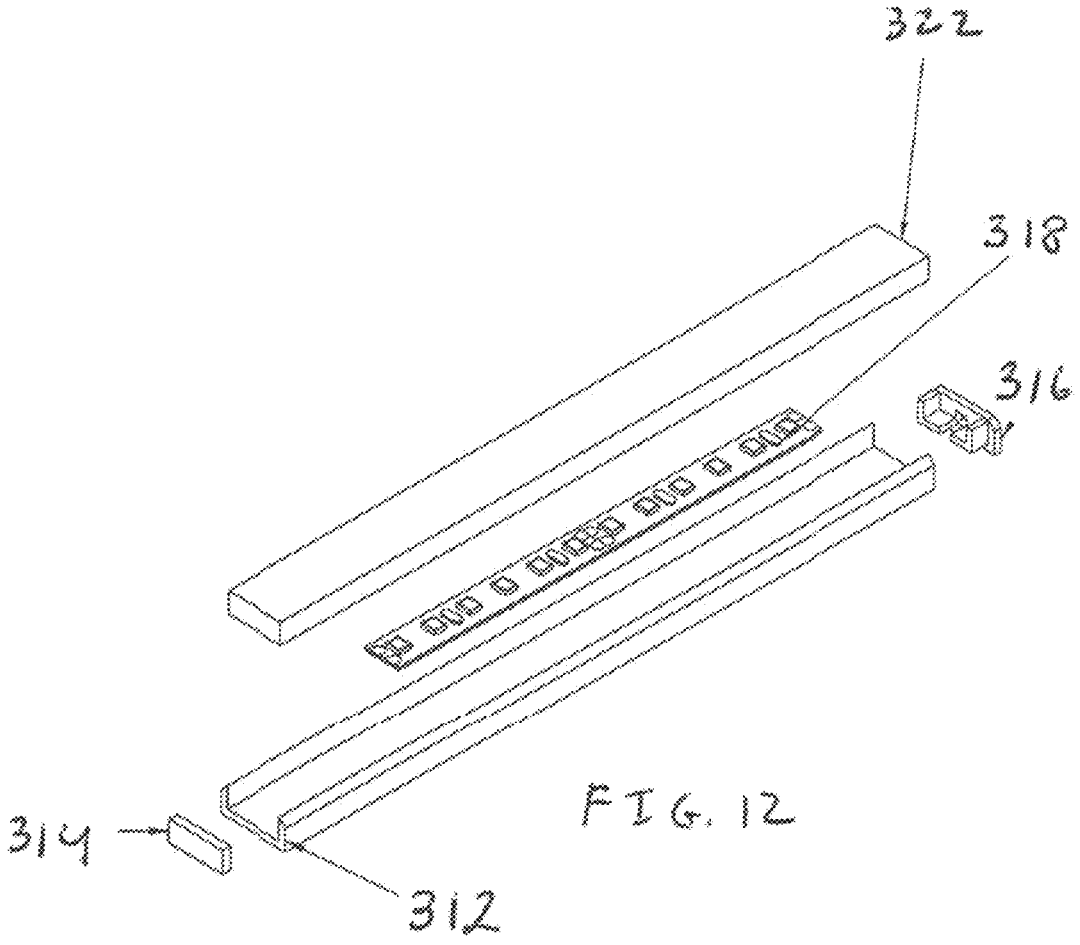
FIG. 12 is an exploded view of the exemplary bendable lighting fixture shown in FIG. 11.
Figure 13:
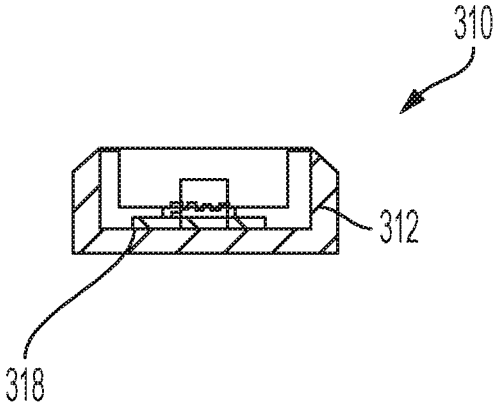
FIG. 13 is a cross-sectional view of the exemplary bendable lighting fixture taken along line 13-13 in FIG. 11.
Figure 13A:
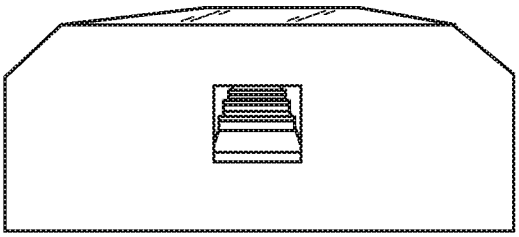
FIG. 13A is a front-end view of the exemplary bendable lighting fixture shown in FIGS. 11A and 11B.

The bendable lighting fixture 310 may also include a filling material 322, for example a polyurethane filling, that produces a substantially flat surface for the bendable lighting fixture 310, so that the bendable lighting fixture 310 may be suitable for use in traveled surfaces, such as walkways, driveways and the like. The filling material 322 is likewise flexible and/or bendable so that it is configured to flex, bend and/or twist along with the profile 312 in order to allow the bendable lighting fixture 310 to be flexed, bent and/or twisted in at least one direction relative to the longitudinal axis of the bendable lighting fixture 310. In this manner, the bendable lighting fixture 310 may be contoured to the surface on which it may be mounted. The filling material 322 is likewise flexible and/or bendable so that it is configured to flex and/or bend along with the bendable lighting fixture 310. The filling material 322 may be a transparent (see e.g. FIGS. 11A, 11B and 11D) or translucent (see e.g. FIG. 11C) material, and may be colored, tinted or dyed to affect the light characteristics of the light emitted from the bendable lighting fixture 310. As shown in FIG. 11C, if a translucent filing material 322 is used, the filling material 322 may act to obscure the individual light emitting elements of the lighting element 318, for example individual LEDs, when the lighting element 318 is illuminated. In this manner, the individual LEDs, for example, are not visible when the bendable lighting fixture 310 is illuminated. The filling material 322 may be poured into the profile 312, and then cured and/or solidified to produce a substantially solid lens for the bendable lighting fixture 310.

The lighting element 318 may be a standard LED board, as shown for example in FIG. 14, and in that case the bendable lighting fixture 310 would be configured to bend and flex as shown in the examples illustrated in FIG. 14. The examples illustrated in FIG. 14 demonstrate that the bendable lighting fixture 310 may be configured to bend omnidirectionally, and may also be configured to bend perpendicular to a surface on which the bendable lighting fixture 310 may be mounted in either a convex or concave direction. In this manner, the bendable lighting fixture 310 may be configured to bend and/or flex as shown in the examples illustrated in FIG. 14 in order to contour to the surface on which the bendable lighting fixture 310 may be mounted. It is understood that the bendable lighting fixture 310 is not limited to the exemplary bending and/or flexing configurations shown in FIG. 14, and a significant number of other bending and/or flexing configuration are possible according to aspects of the present invention, including, but not limited to those configurations shown in FIGS. 40A-40E. In this manner, the bendable lighting fixture 310 may be installed on a variety of differently contoured surfaces due to the flexible nature of the bendable lighting fixture 310. Optionally, the lighting element may be a flexible LED board, as shown for example in FIGS. 15 and 39, and in that case the bendable lighting fixture 310 would be configured to bend and flex as shown in FIG. 15 to provide for omnidirectional bending of the bendable lighting fixture 310 relative to a surface on which the bendable lighting fixture 310 may be mounted. The bendable lighting fixture 310 may be suitable for indoor and outdoor lighting applications, and may be configured to be water resistant or waterproof thereby allowing for use of the bendable lighting fixture 310 in locations exposed to moisture and/or the elements. Such applications in which the bendable lighting fixture 310 may be exposed to moisture and/or the elements may include, but are not limited to, walkway surfaces, driveway surfaces and underwater lighting surfaces, such as pool or aquarium locations. It is understood that the water resistance, and or water proofing, of the bendable lighting fixture 310 may be provided at least in part by the filling material 322 creating at least a substantially watertight seal with the profile 312.

Figure 20A:
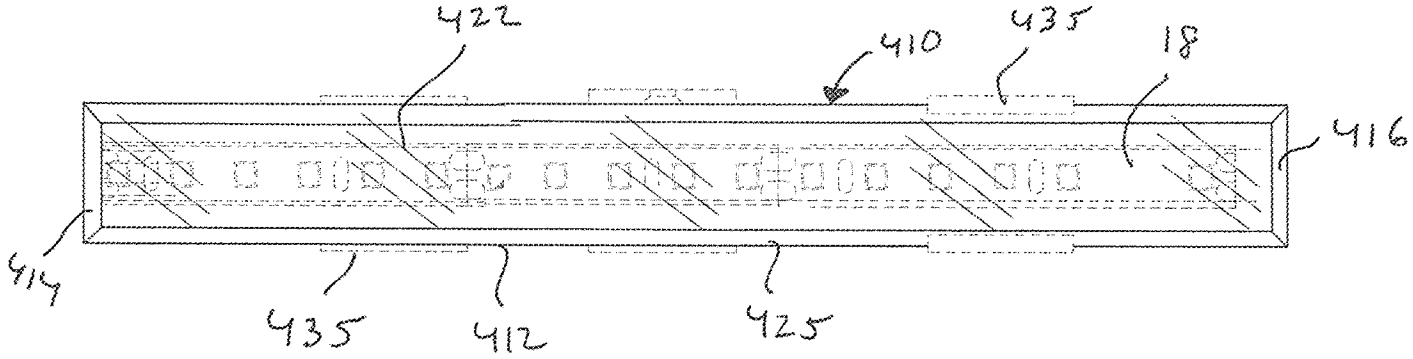
FIG. 20A is a top plan view of the exemplary bendable lighting fixture show in FIG. 21 with a transparent filling material.

Referring now to FIGS. 16-20, 20A, 21, 21A, 21B, 22-24, 25A, 25B and 26-29, therein illustrated is an exemplary embodiment of a bendable lighting fixture, generally indicated by reference numeral 410, according to an exemplary aspect of the present invention. The bendable lighting fixture 410 may include a profile 412, which may be made from a flexible material, such as a flexible plastic, rubber, thermoplastic material, polymer or ceramic. Constructing the profile 412 of a flexible material allows the profile 412 to be bent, flexed and/or twisted in at least one direction relative to the longitudinal axis of the profile 412. The profile 412 of the bendable lighting fixture 410 may include one or more end caps 414, 416 that are configured and dimensioned to be positioned and removably secured at one or more of the ends of the profile 412. It is understood that the end caps 414, 416, although different in configuration, may be configured so that each end cap 414 or 416 may be positioned at each end of the profile 412. One or more of the end caps 414, 416 may include a passageway for electrical wiring or the like. The bendable lighting fixture 410 may be configured for receipt and retention of a lighting element 418, for example a light emitting diode (LED) lighting strip. The lighting element 418 may preferably likewise be bendable in the same manner as the bendable lighting fixture 410. It is understood that the lighting element 418 may be the same or substantially the same as lighting elements 18, 118, 218 and/or 318 discussed above. In other words, it is understood that lighting elements 18, 118, 218, 318 and 418 may be substantially interchangeable, as shown for example in FIGS. 20A and 21B in which lighting element 18 is included in the bendable lighting fixture 410. The bendable lighting fixture 410 may also include a spacer lens (not shown) that is configured for positioning over the lighting element 418 to allow for adjustment of the lighting characteristics of the light emitted from the lighting element 418. For example, the material used for the spacer lens (not shown), the thickness and/or height of the spacer lens (not shown) from the lighting element 418 are examples of possible adjustments that can be made to affect the light characteristics, e.g. color, hue, brightness, warmth, etc., of the light perceived as being emitted from the bendable lighting fixture 410. The spacer lens (not shown) may be made from a suitably flexible and/or bendable translucent or transparent material. It is understood that the spacer lens (not shown) may also be colored, tinted and/or dyed as another means of affecting the light characteristics of the light ultimately emitted from the bendable lighting fixture 410.

Figure 21A:
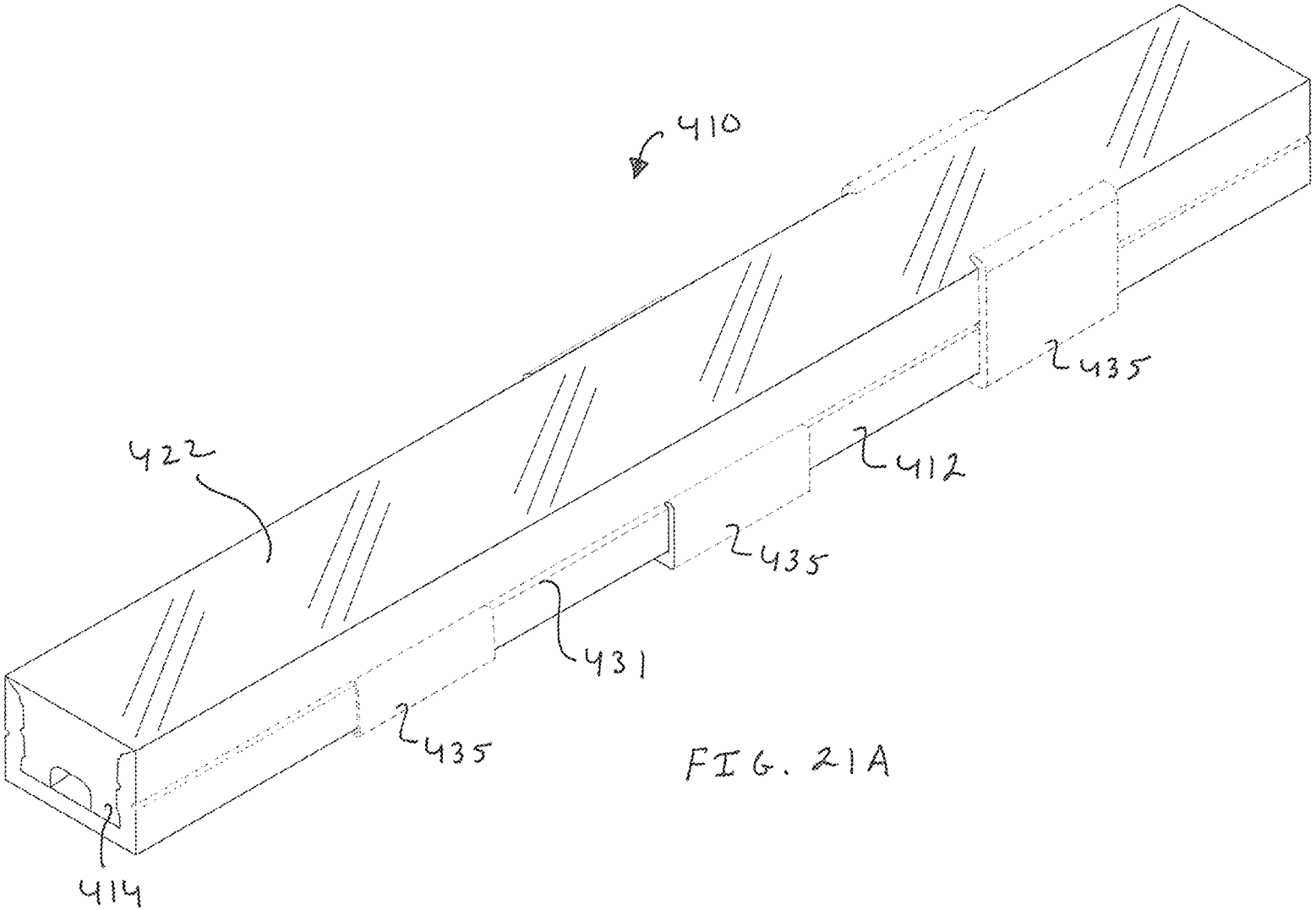
FIG. 21A is an isometric view of the exemplary bendable lighting fixture shown in FIG. 21 with a translucent filling material.
Figure 21B:
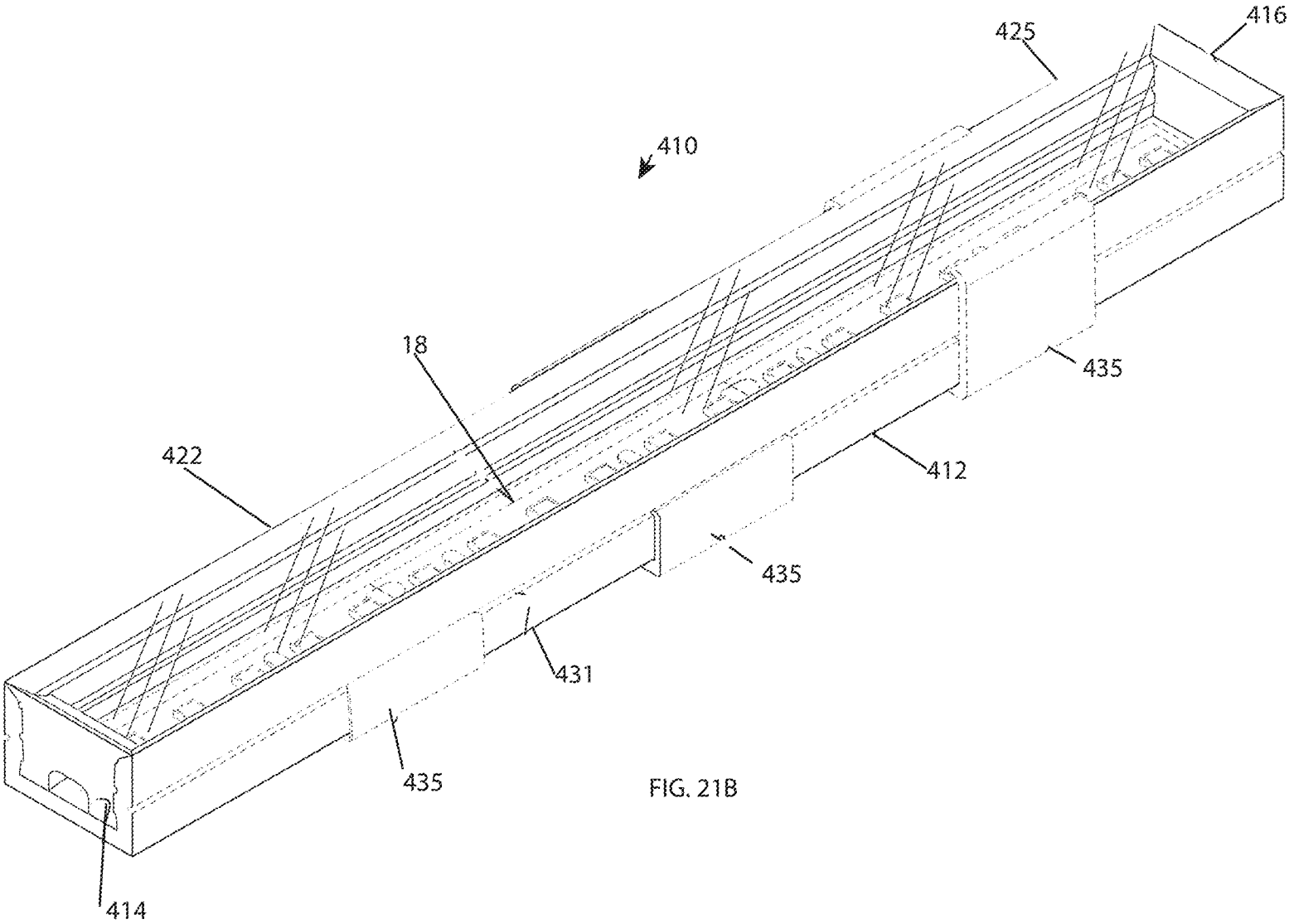
FIG. 21B is an isometric view of the exemplary bendable lighting fixture shown in FIG. 21 with a transparent filling material.
Figure 25A:
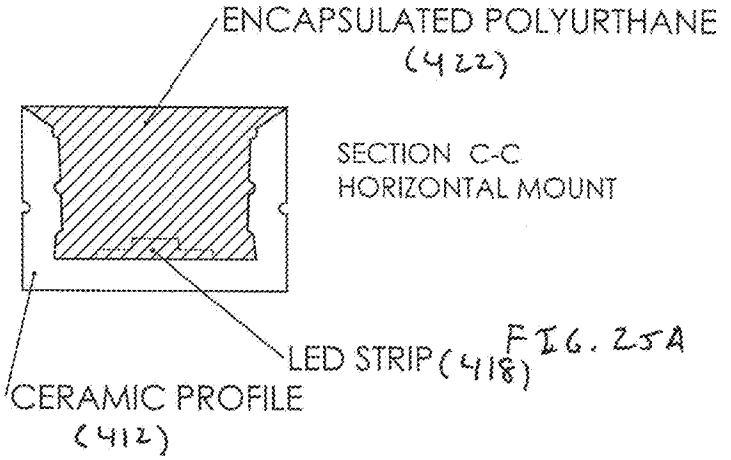
FIG. 25A is a cross-sectional view of the exemplary bendable lighting fixture taken along line C-C in FIG. 24 showing an exemplary position of a lighting element.
Figure 25B:
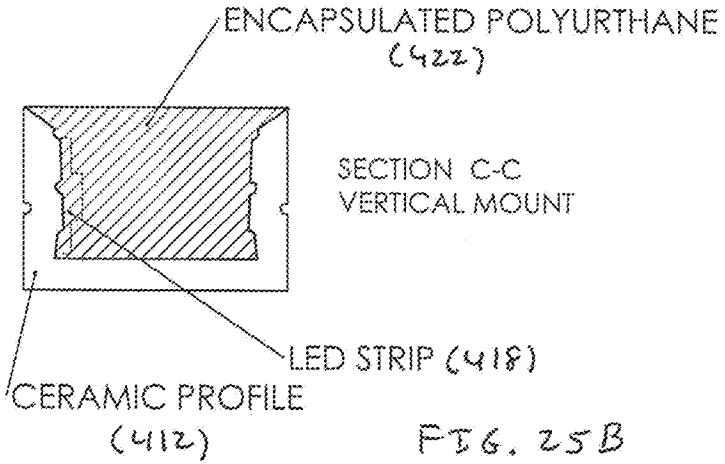
FIG. 25B is a cross-sectional view of the exemplary bendable lighting fixture taken along line C-C in FIG. 24 showing an exemplary position of a lighting element.
Figure 24:
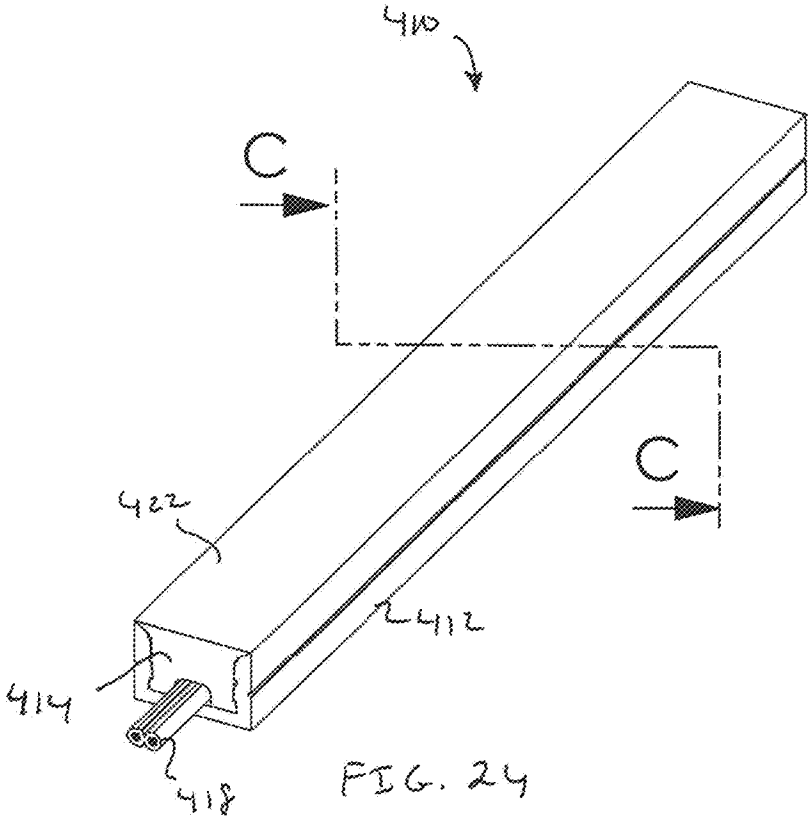
FIG. 24 is an isometric view of the exemplary bendable lighting fixture.
Figure 27:
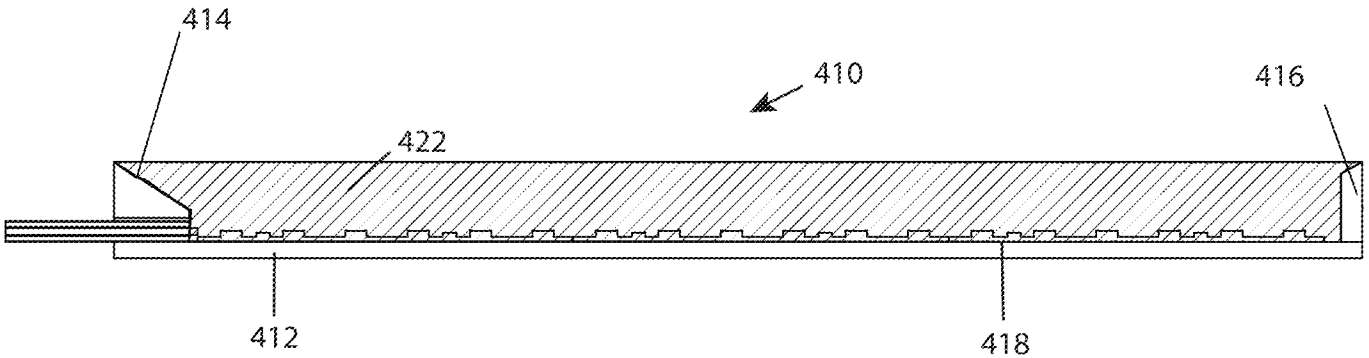
FIG. 27 is a cross-sectional view of the exemplary bendable lighting fixture taken along line 27-27 in FIG. 26.
Figure 26:
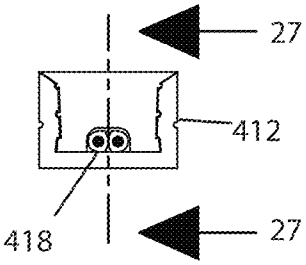
FIG. 26 is front view of the exemplary bendable lighting fixture shown in FIG. 21.
Figure 29:
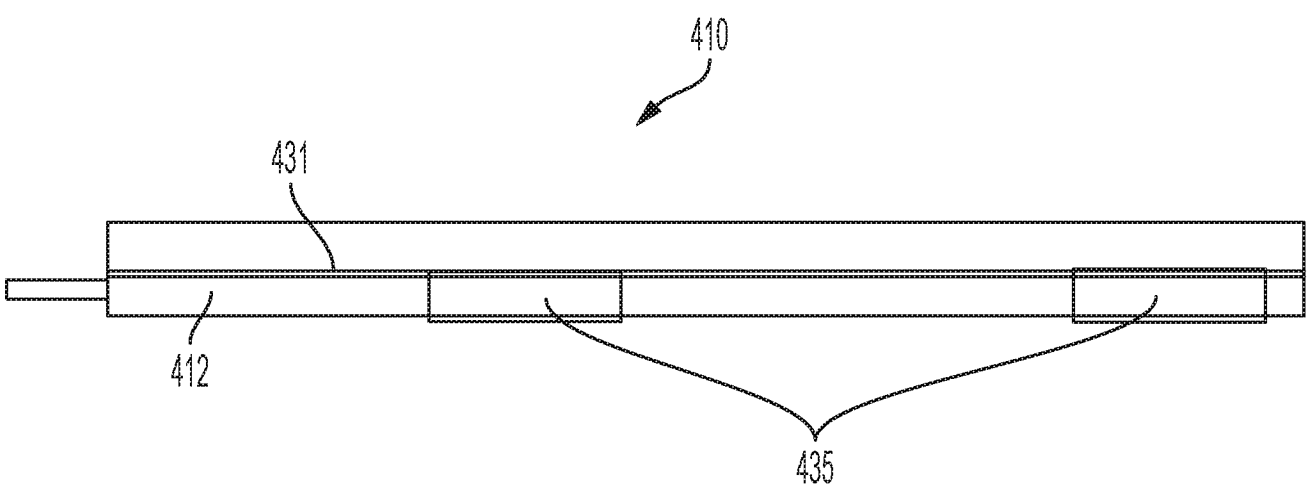
FIG. 29 is side view of the exemplary bendable lighting fixture shown in FIG. 21 having mounting clips disposed thereon.
Figure 28:
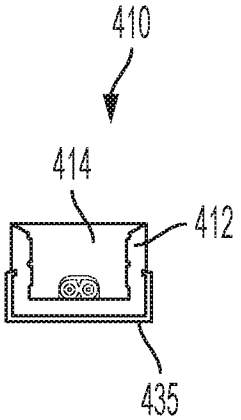
FIG. 28 is front view of the exemplary bendable lighting fixture shown in FIG. 21 having mounting clips disposed thereon.

The bendable lighting fixture 410 may also include a filling material 422, for example a polyurethane filling, that produces a substantially flat surface for the bendable lighting fixture 410, so that the bendable lighting fixture 410 may be suitable for use in traveled surfaces, such as walkways, driveways and the like. The filling material 422 is likewise flexible and/or bendable so that it is configured to flex and/or bend along with the bendable lighting fixture 410. In this manner, the bendable lighting fixture 410 may be contoured to the surface on which it may be mounted. The filling material 422 may be a transparent (see e.g. FIGS. 20A and 21B) or translucent (see e.g. FIG. 21A) material, and may be colored, tinted and/or dyed to affect the light characteristics of the light emitted from the bendable lighting fixture 410. As shown in FIG. 21A, if a translucent filing material 422 is used, the filling material 422 may act to obscure the individual light emitting elements of the lighting element 418, for example individual LEDs, when the lighting element 418 is illuminated. In this manner, the individual LEDs, for example, are not visible when the bendable lighting fixture 410 is illuminated. The filling material 422 may be poured into the profile 412, and then cured and/or solidified to produce a substantially solid lens for the bendable lighting fixture 410.

The lighting element 418 may be a standard LED board, as shown for example in FIG. 14, and in that case the bendable lighting fixture 410 would be configured to bend and flex as shown in the examples illustrated in FIG. 14. In this manner, the bendable lighting fixture 410 may be configured to bend and/or flex as shown in the examples illustrated in FIG. 14 in order to contour to the surface on which the bendable lighting fixture 410 may be mounted. It is understood that the bendable lighting fixture 410 is not limited to the exemplary bending and/or flexing configurations shown in FIG. 14, and a significant number of other bending and/or flexing configuration are possible according to aspects of the present invention, including, but not limited to those configurations shown in FIGS. 40A-40E. In this manner, the bendable lighting fixture 410 may be installed on a variety of differently contoured surfaces due to the flexible nature of the bendable lighting fixture 410. Optionally, the lighting element may be a flexible LED board, as shown for example in FIGS. 15 and 39, and in that case the bendable lighting fixture 410 would be configured to bend and flex as shown in FIG. 15 to provide for omnidirectional bending of the bendable lighting fixture 410 relative to a surface on which the bendable lighting fixture 410 may be mounted. The bendable lighting fixture 410 may be suitable for indoor and outdoor lighting applications, and may be configured to be water resistant or waterproof thereby allowing for use of the bendable lighting fixture 410 in locations exposed to moisture and/or the elements. Such applications in which the bendable lighting fixture 410 may be exposed to moisture and/or the elements may include, but are not limited to, walkway surfaces, driveway surfaces and underwater lighting surfaces, such as pool or aquarium locations. It is understood that the water resistance, and or water proofing, of the bendable lighting fixture 410 may be provided at least in part by the filling material 422 creating at least a substantially watertight seal with the profile 412.

Referring now particularly to FIGS. 16-19, the profile 412 of the bendable lighting fixture 410 may include angles 425 at an opening of the profile to provide a taper for emission of light from the bendable lighting fixture 410. The profile 412 may also include one or more lighting element 418 mounting areas 427 that are positioned to allow for horizontal and/or vertical mounting of the lighting element 418 within the profile. The profile 412 may also include one or more air gap mating features 429. The profile 412 may also include a mounting clip edge 431 extending at least partially along the exterior sides of the profile 412 to provide a connection point for one or more mounting clips 435, as shown for example in FIGS. 20A, 21A-21B, 28 and 29. The mounting clips 435 may be secured to a surface (not shown), and permit removable attachment of the bendable lighting fixture 410 to the surface.

Figure 31:
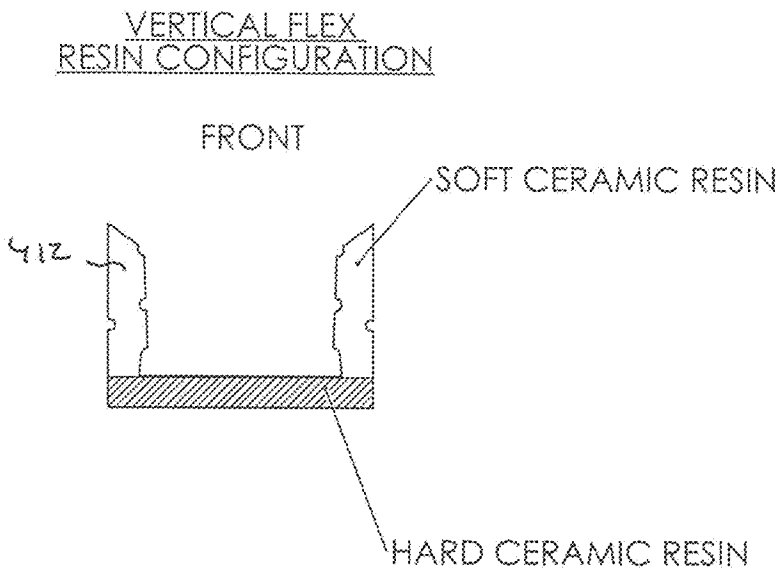
FIGS. 31 & 31A are a front view of a profile of an exemplary bendable lighting fixture having mixed material composition.
Figure 30:
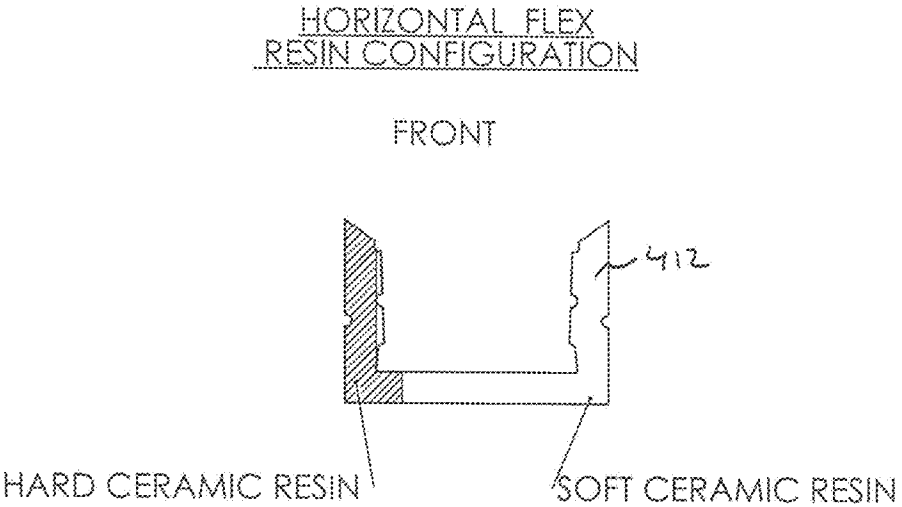
Figures 31A, 33, 35:
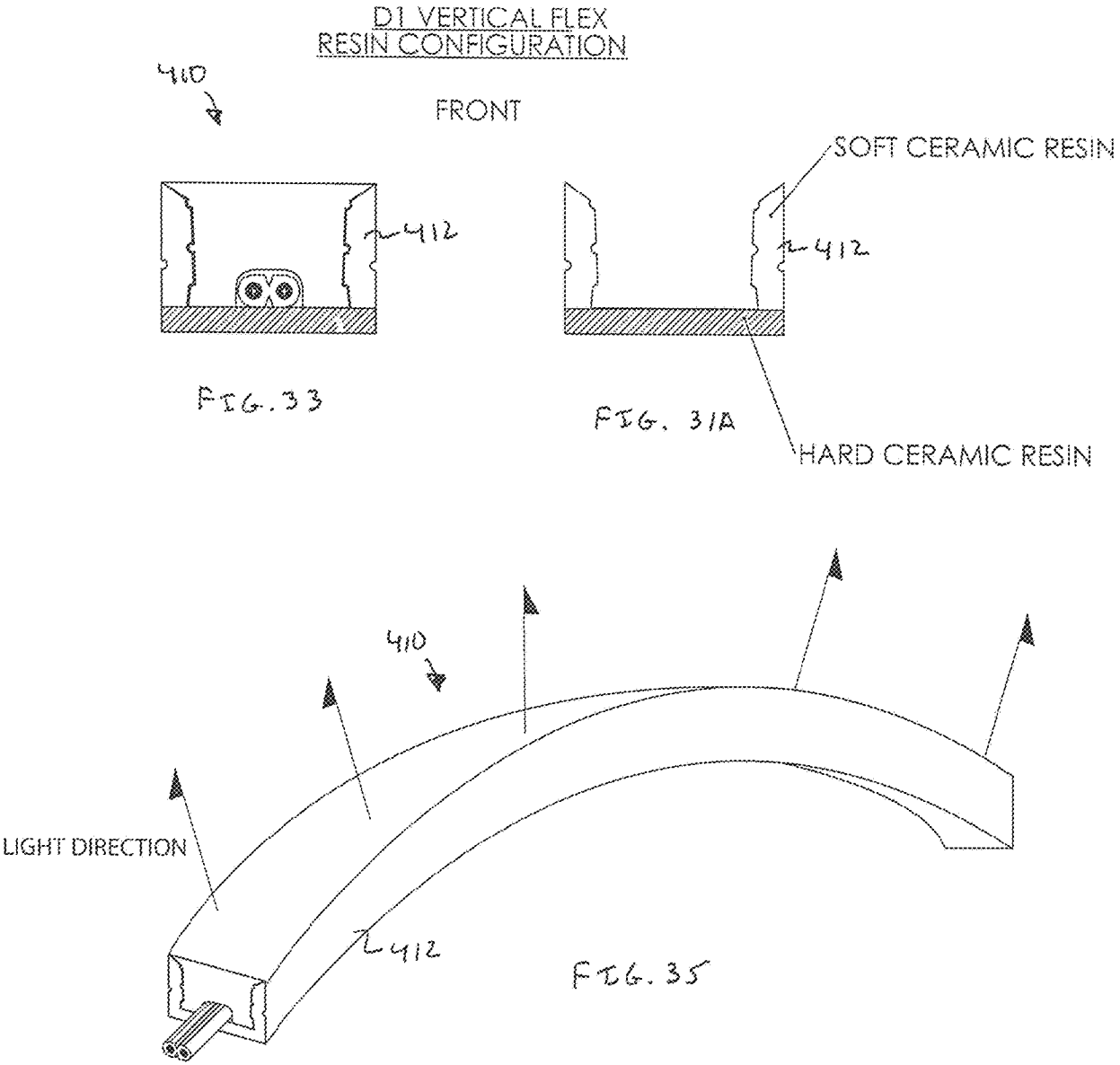
FIG. 33 is a front view of an exemplary bendable lighting fixture having mixed material composition.
FIG. 35 is an isometric view of exemplary flexing of the exemplary bendable lighting fixture from FIG. 33.
Figure 38:
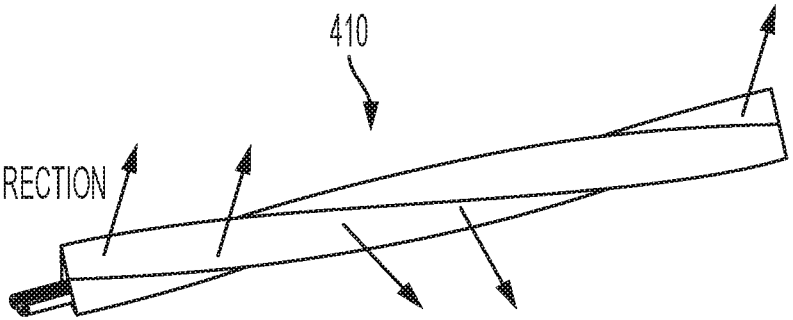
FIG. 38 is an isometric view of exemplary flexing of the exemplary bendable lighting fixture from FIG. 36.
Figure 37:
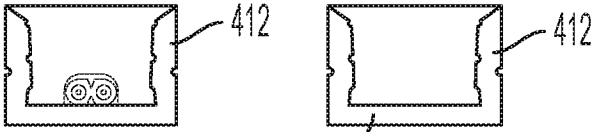
FIG. 37 is a front view of a profile of an exemplary bendable lighting fixture having a uniform material composition.
Figure 36:
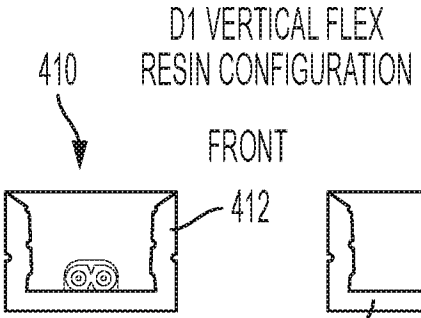
FIG. 36 is a front view of an exemplary bendable lighting fixture having a uniform material composition.
Figure 40A:
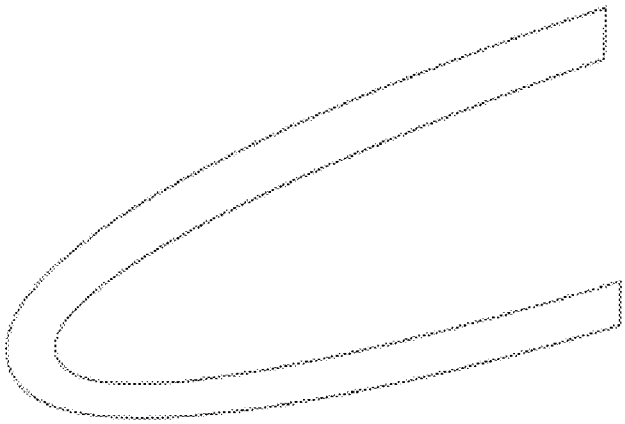
FIG. 40A illustrates an exemplary configuration of an exemplary bendable lighting fixture according to the present invention.
Figure 40B:
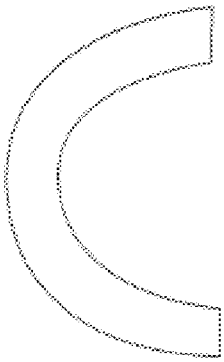
FIG. 40B illustrates an exemplary configuration of an exemplary bendable lighting fixture according to the present invention.
Figure 40C:
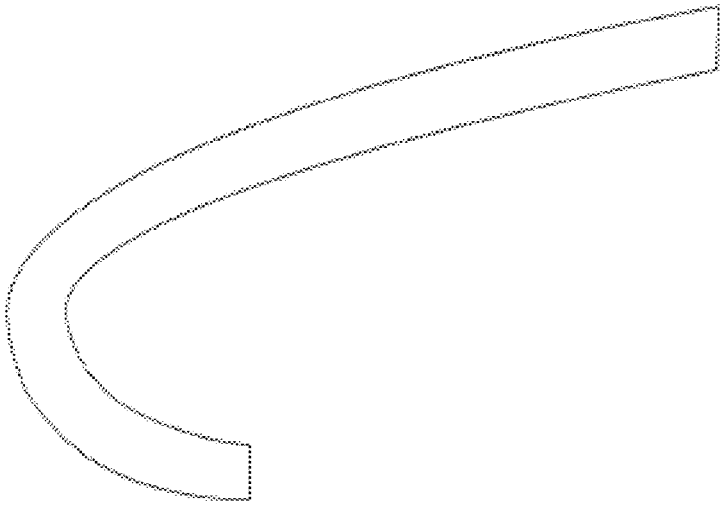
FIG. 40C illustrates an exemplary configuration of an exemplary bendable lighting fixture according to the present invention.
Figure 40D:
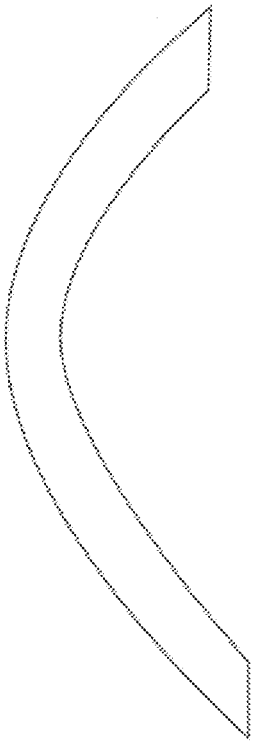
FIG. 40D illustrates an exemplary configuration of an exemplary bendable lighting fixture according to the present invention.
Figure 40E:
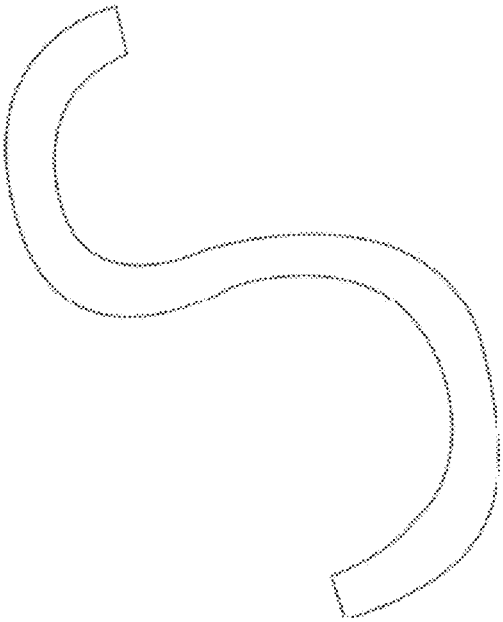
FIG. 40E illustrates an exemplary configuration of an exemplary bendable lighting fixture according to the present invention.

Referring now to FIGS. 30, 30A, 31, 31A and 32-40, therein illustrated are exemplary constructions of the profile 412 of the bendable lighting fixture 410 according to the present invention. As shown in the figures, the profile 412 may be constructed of partially or fully rigid material and flexible material (see e.g. FIGS. 30, 30A, 31, 31A) or entirely constructed of flexible material (see e.g. FIGS. 36 and 37). It is understood that the partially or fully rigid material permits flex of the profile 412 in a particular direction, but may at least partially prevent and/or resist flex of the profile in directions substantially perpendicular to the particular direction. For example, as shown in FIGS. 31, 31A and 33, the profile 412 may be constructed of a rigid material that permits bending of the bendable lighting fixture 410 up and down as demonstrated by FIG. 35, but does not permit side bending of the bendable lighting fixture 410. This can be accomplished by using a material for the base of the profile 412 that is bendable with respect to up and down forces applied to the profile 412, but is resistant to side-to-side forces applied to the profile 412. Likewise, as shown in FIGS. 30, 30A and 34, the profile 412 may be constructed of a rigid material that permits bending of the bendable lighting fixture 410 side-to-side as demonstrated by FIG. 34, but does not permit up and down bending of the bendable lighting fixture 410. This can be accomplished by using a material for either or both sides of the profile 412 that is bendable with respect to side-to-side forces applied to the profile 412, but is resistant to up and down forces applied to the profile 412. If no rigid materials are used for any significant portion of the profile 412, as shown for example in FIGS. 36-37, than the bendable lighting fixture 410 may have the bending characteristics as demonstrated by FIG. 38. It is understood that the bending characteristics discussed with respect to bendable lighting fixture 410 apply equally well to construction and bending of the other bendable lighting fixtures discussed herein.

Figure 41:
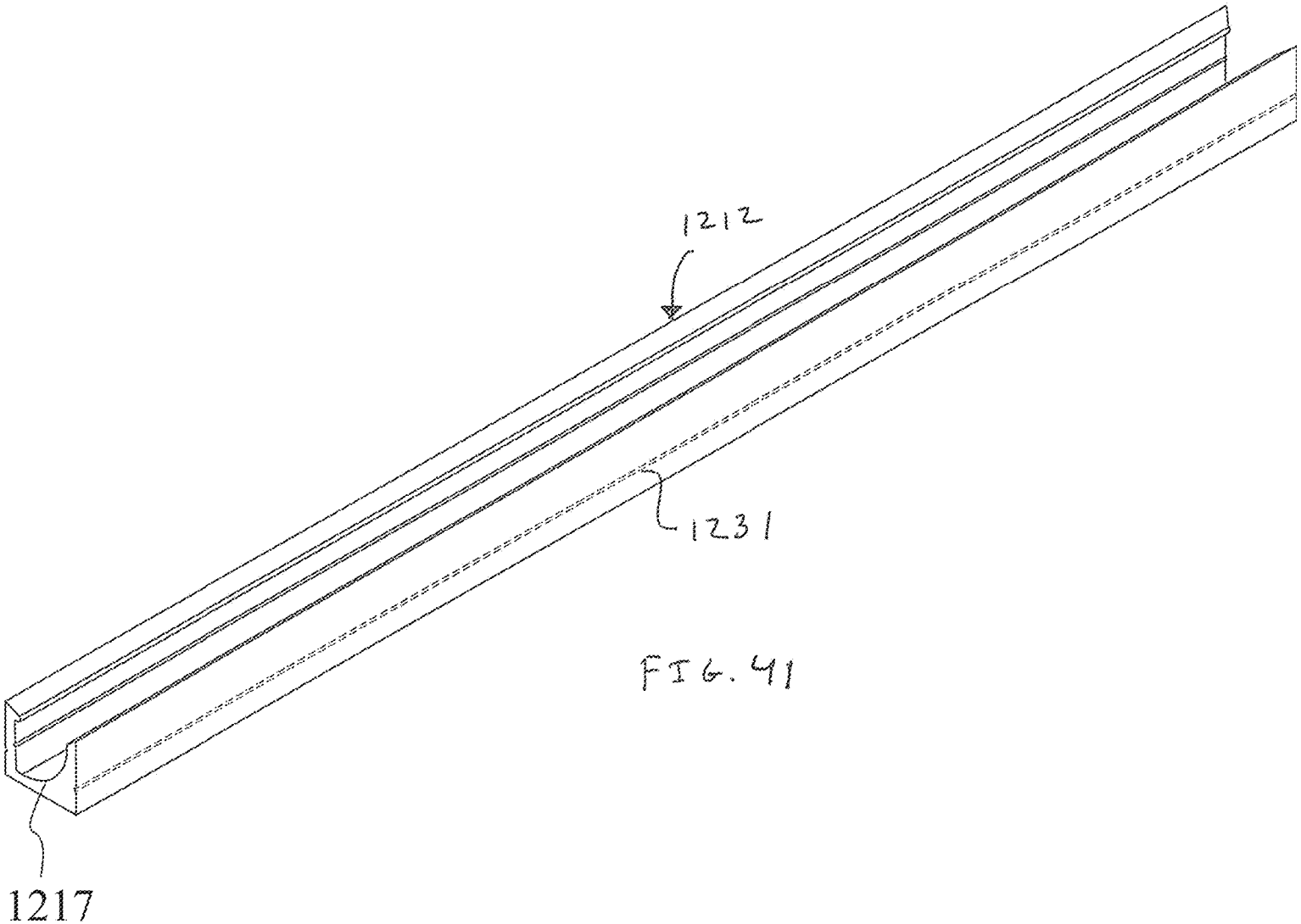
FIG. 41 is an isometric view of an exemplary profile for the exemplary bendable lighting fixture shown in FIGS. 44 and 45.
Figure 42:
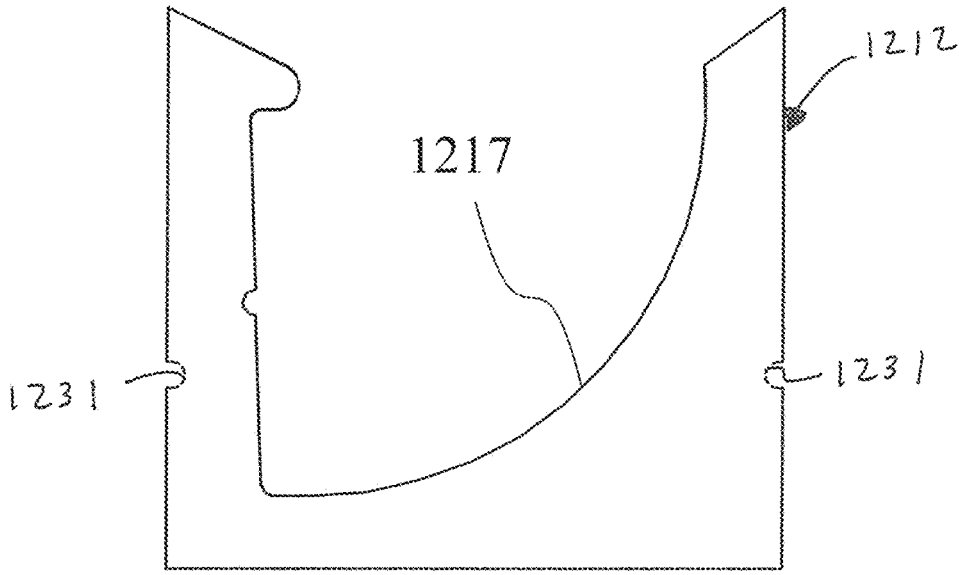
FIG. 42 is a front view of the exemplary profile for the exemplary bendable lighting fixture shown in FIGS. 44 and 45.
Figure 43:
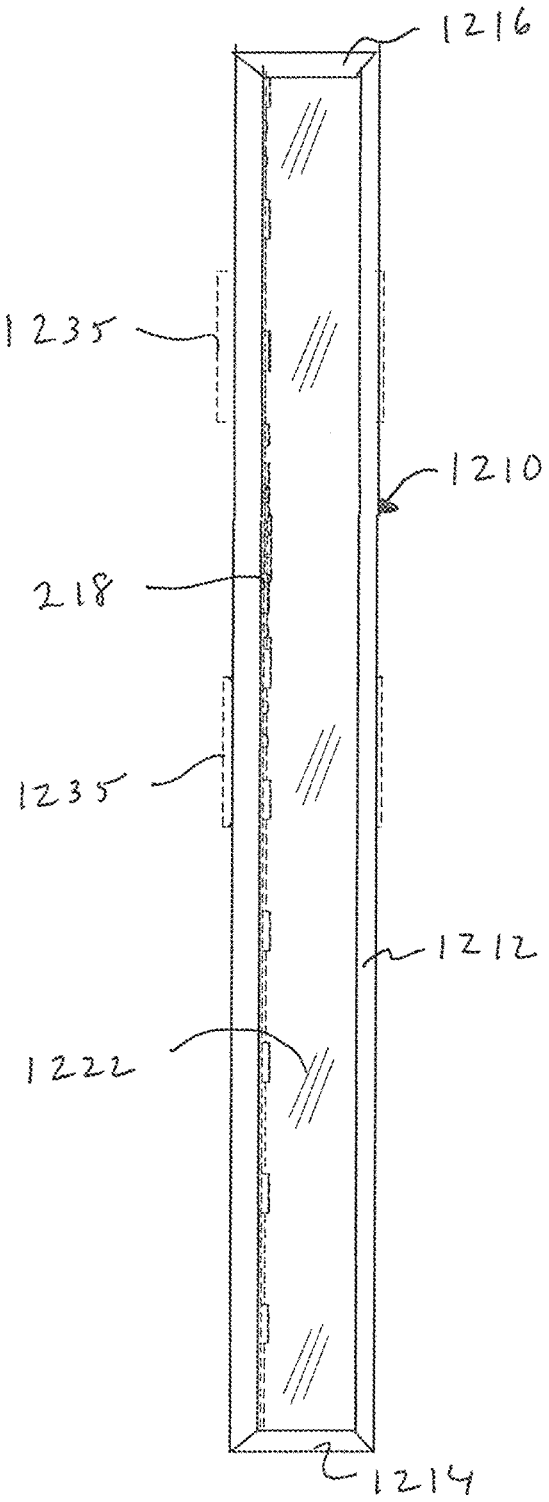
FIG. 43 is a top plan view of the exemplary bendable lighting fixture shown in FIG. 45.
Figure 44:
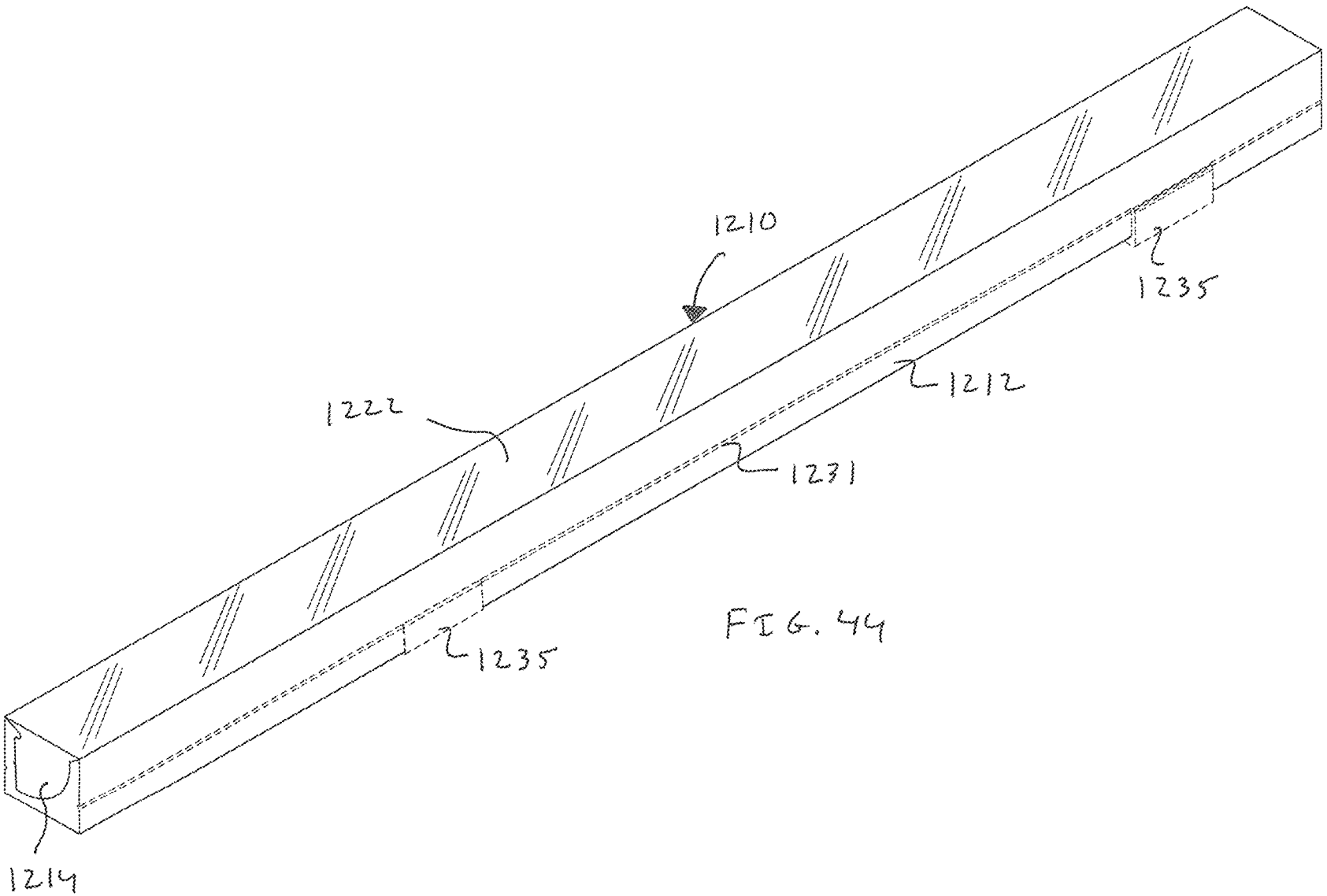
FIG. 44 is an isometric view of the exemplary bendable lighting fixture having a translucent filling material according to the present invention.
Figure 45:
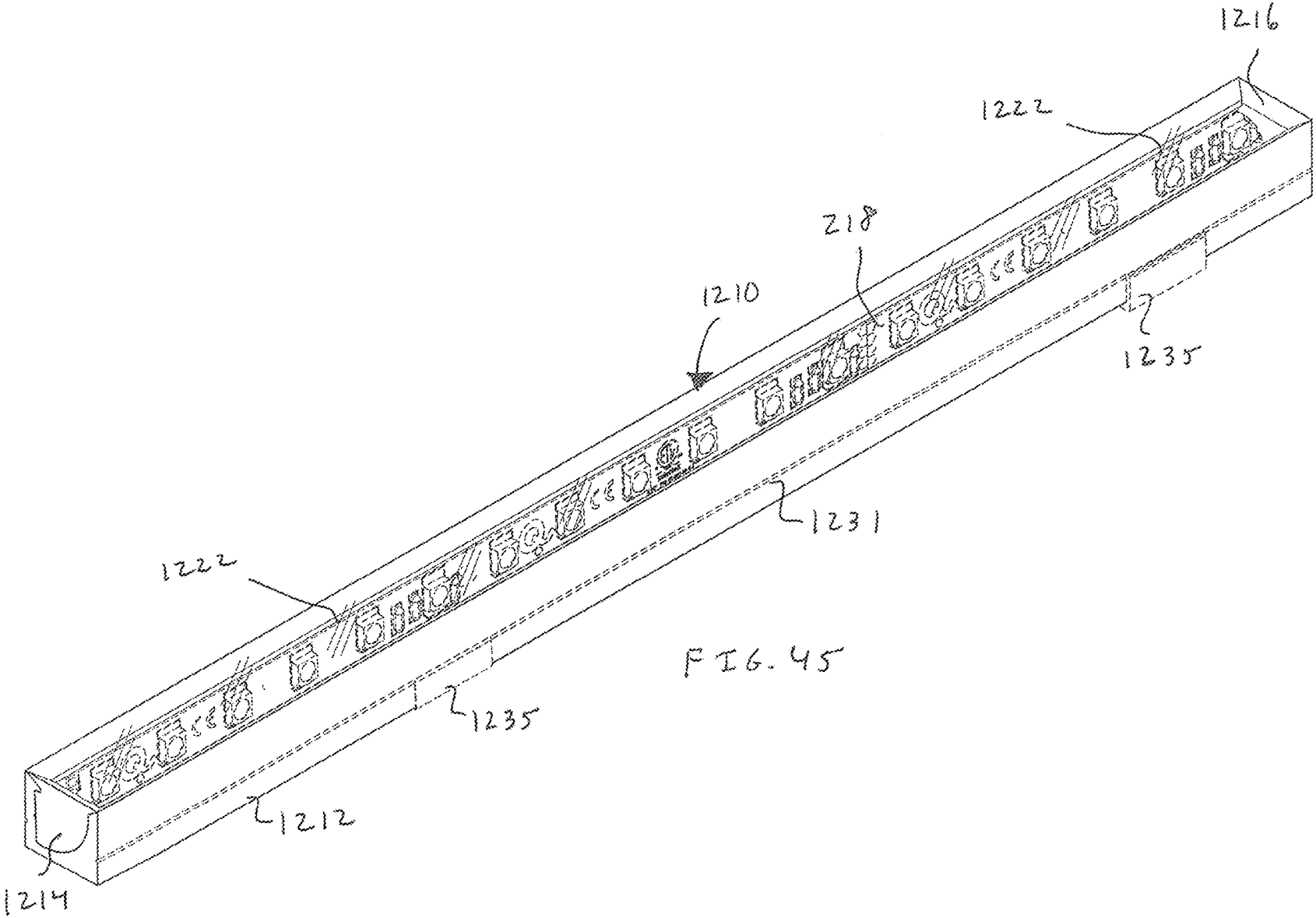
FIG. 45 is an isometric view of the exemplary bendable lighting fixture having a transparent filling material according to the present invention.
Figure 46:
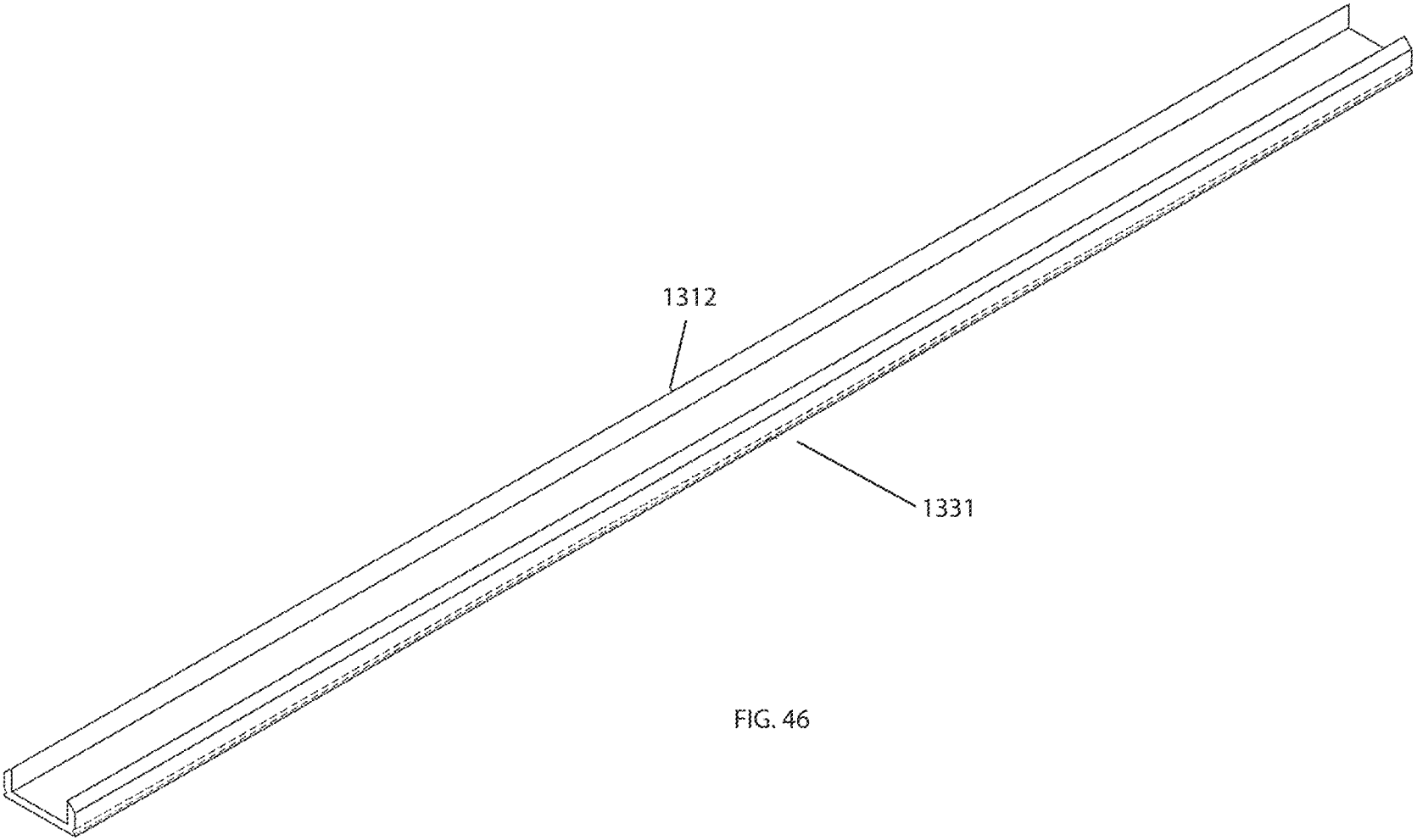
FIG. 46 is an isometric view of an exemplary profile for the exemplary bendable lighting fixture shown in FIGS. 48 and 49.
Figure 47:
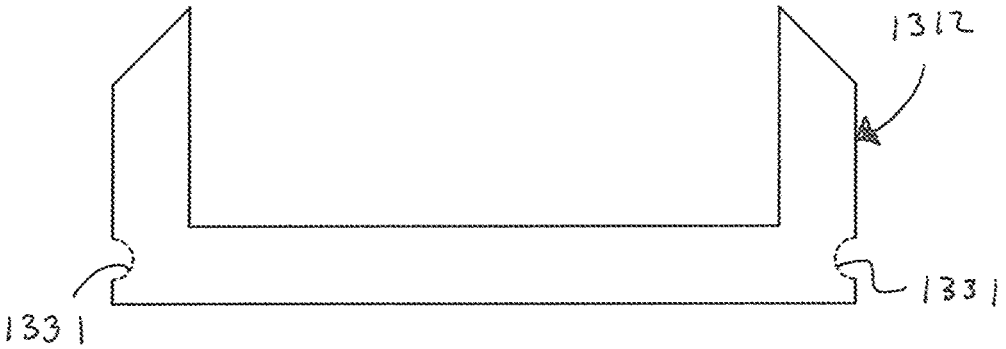
FIG. 47 is a front view of the exemplary profile for the exemplary bendable lighting fixture shown in FIGS. 48 and 49.
Figure 48:
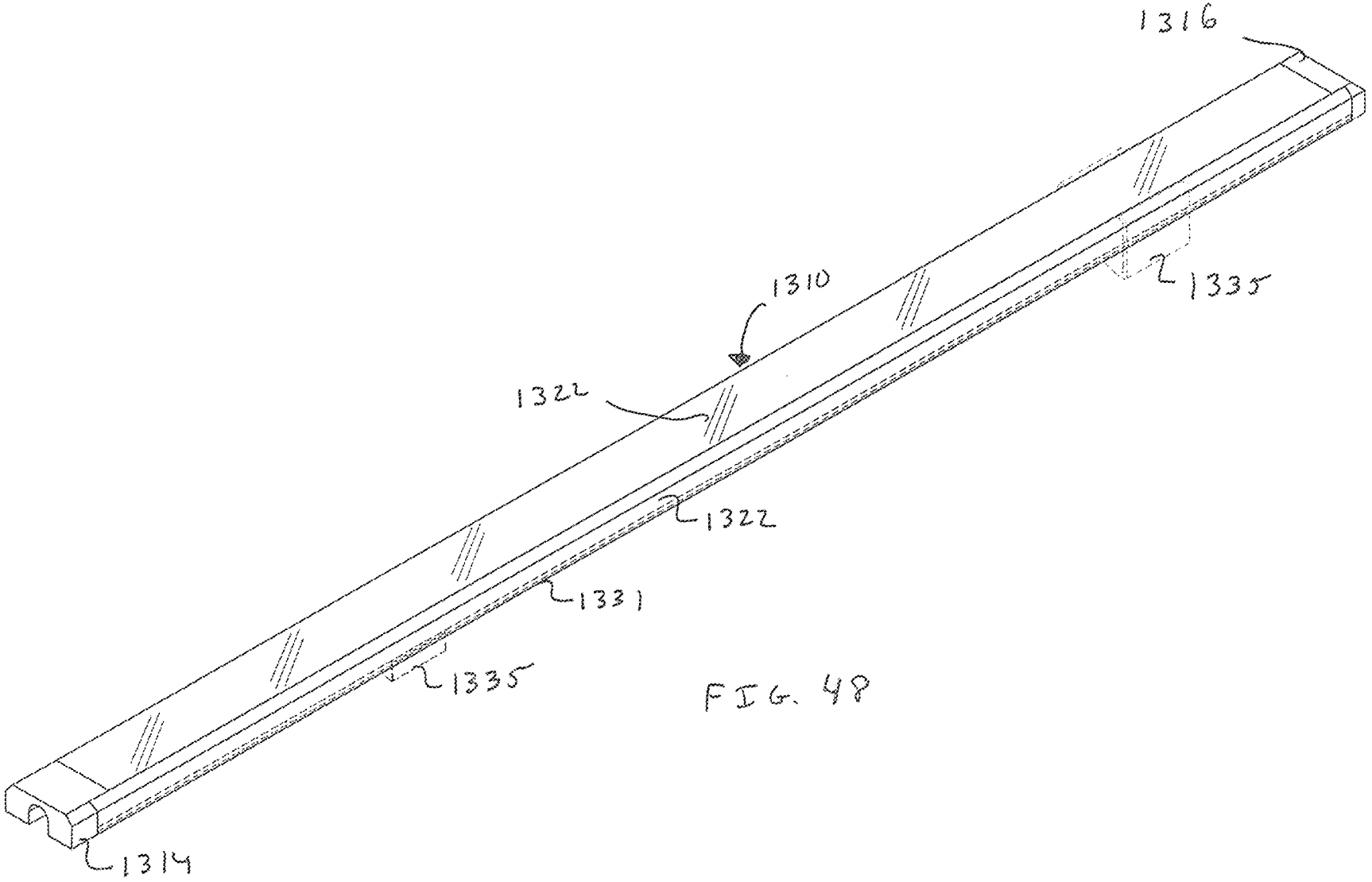
FIG. 48 is an isometric view of the exemplary bendable lighting fixture having a translucent filling material according to the present invention.
Figure 49:
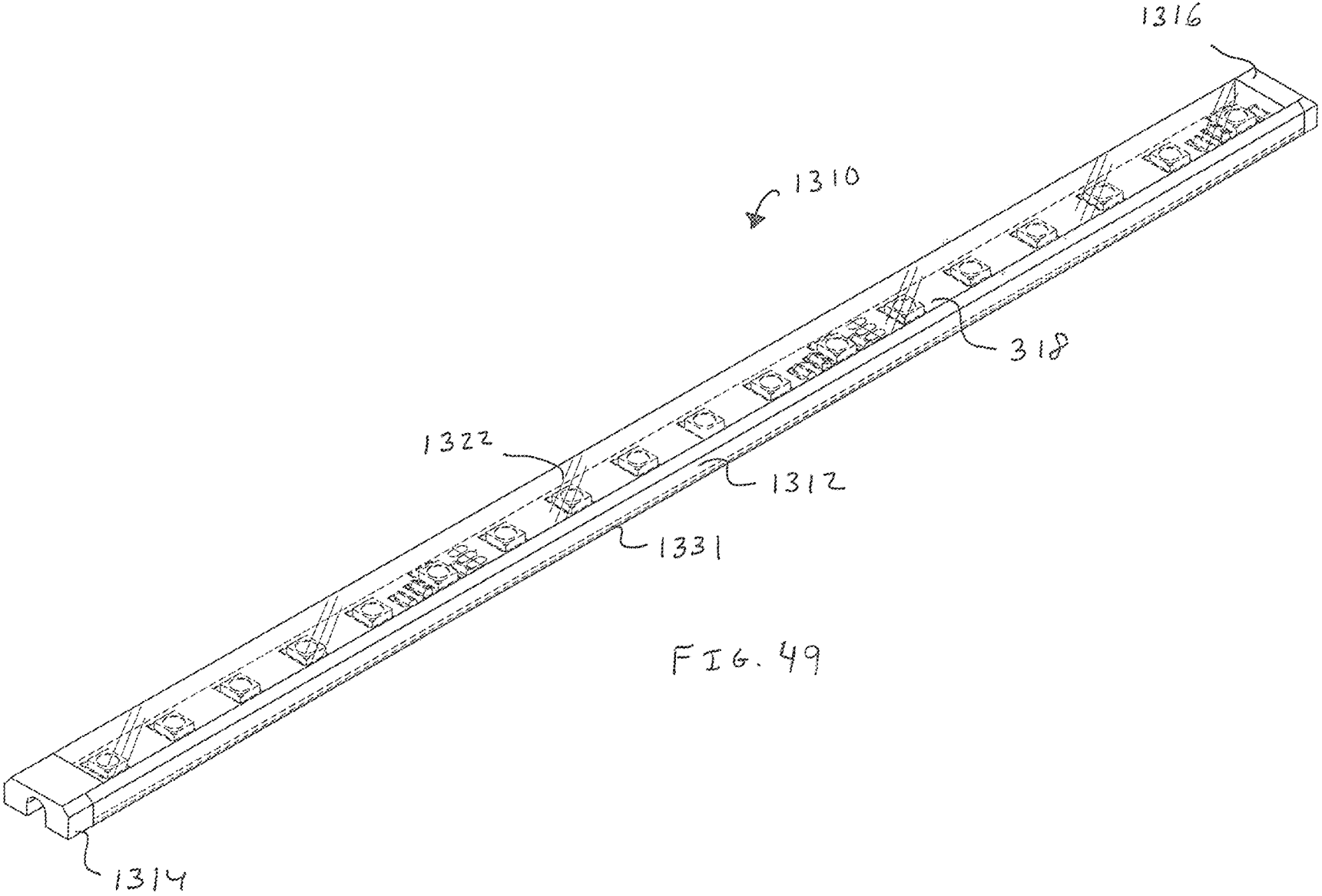
FIG. 49 is an isometric view of the exemplary bendable lighting fixture having a transparent filling material according to the present invention.

Referring now to FIGS. 41-45, therein illustrated is an exemplary embodiment of a bendable lighting fixture, generally indicated by reference numeral 1210, according to an exemplary aspect of the present invention. The bendable lighting fixture 1210 may include a profile 1212, which may be made from a flexible material, such as a flexible plastic, rubber, thermoplastic material, polymer or ceramic. The profile 1212 of the bendable lighting fixture 1210 may include one or more end caps 1214, 1216 that are configured and dimensioned to be positioned and removably secured at one or more of the ends of the profile 1212. It is understood that the end caps 1214, 1216, although different in configuration, may be configured so that each end cap 1214 or 1216 may be positioned at each end of the profile 1212. One or both end caps 1214, 1216 may include an opening formed therein to provide a passage for wires to extend from the interior of the bendable lighting fixture 1210 to the exterior of the bendable lighting fixture 1210. The profile 1212 of the bendable lighting fixture 1210 may include a curved surface 1217 positioned within the interior region of the profile 1212. The curved surface 217 may be a substantially concave surface as shown in FIG. 41-42, but it is understood that the present invention is not limited to any particular configuration of the curved surface 1217, and the curved surface may be convex or substantially slanted and still contemplated by the various aspects of the presented invention. The bendable lighting fixture 1210 may be configured for receipt and retention of a lighting element 218, for example a light emitting diode (LED) lighting strip. The lighting element 218 may preferably likewise be bendable in the same manner as the bendable lighting fixture 1210. It is understood that the lighting element 218 may be the same or substantially the same as the lighting elements 18, 118, 318 and 418 discussed above. In other words, it is understood that lighting elements 18, 118, 218, 318 and 418 may be substantially interchangeable. The curved surface 1217 of the profile 1212 may act redirect the light emitted from the lighting element 218 in order to produce lighting effects from the bendable lighting fixture 1210 and/or obscure the individual dots of light that may be emitted from the lighting element 218, for example if the lighting element 218 is a LED lighting strip.

The bendable lighting fixture 1210 may also optionally include a louver (not shown) that is configured for positioning over the lighting element 218 to separate the individual light transmitting nodes of the lighting element 218. The louver may be substantially the same configuration and/or construction of the louver 221 discussed above with respect to bendable lighting fixture 210. The bendable lighting fixture 1210 may also include a filling material 1222, for example a polyurethane filling, that produces a substantially flat surface for the bendable lighting fixture 1210, so that the bendable lighting fixture 1210 may be suitable for use in traveled surfaces, such as walkways, driveways and the like. The filling material 1222 is likewise flexible and/or bendable so that it is configured to flex and/or bend along with the bendable lighting fixture 1210. The filling material 222 may be a transparent (see e.g. FIGS. 43 and 45) or translucent (see e.g. FIG. 44) material, and may be colored, tinted or dyed to affect the light characteristics of the light emitted from the bendable lighting fixture 1210. The filling material 1222 may be poured into the profile 1212, and then cured and/or solidified to produce a substantially solid lens for the bendable lighting fixture 1210. The bendable lighting fixture 1210 may be configured to flex and/or bend in the same manner as the bendable lighting fixture 210 discussed above. The bendable lighting fixture 1210 may be suitable for indoor and outdoor lighting applications, and may be configured to be water resistant or waterproof. It is understood that the water resistance, and or water proofing, of the bendable lighting fixture 1210 may be provided at least in part by the filling material 1222 creating at least a substantially watertight seal with the profile 1212. The profile 1212 of the bendable lighting fixture 1210 may include a mounting clip edge 1231 extending at least partially along the exterior sides of the profile 1212 to provide a connection point for one or more mounting clips 1235, as shown for example in FIGS. 43-45. The mounting clips 1235 may be secured to a surface (not shown), and permit removable attachment of the bendable lighting fixture 1210 to the surface.

Referring now to FIGS. 46-49, therein illustrated is an exemplary embodiment of a bendable lighting fixture, generally indicated by reference numeral 1310, according to an exemplary aspect of the present invention. The bendable lighting fixture 1310 may include a profile 1312, which may be made from a flexible material, such as a flexible plastic, rubber, thermoplastic material, polymer or ceramic. The profile 1312 of the bendable lighting fixture 1310 may include one or more end caps 1314, 1316 that are configured and dimensioned to be positioned and removably secured at one or more of the ends of the profile 1312. It is understood that the end caps 1314, 1316, although different in configuration, may be configured so that each end cap 1314 or 1316 may be positioned at each end of the profile 1312. One or both end caps 1314, 1316 may include an opening formed therein to provide a passage for wires to extend from the interior of the bendable lighting fixture 1310 to the exterior of the bendable lighting fixture 1310. The bendable lighting fixture 1310 may be configured for receipt and retention of a lighting element 318, for example a light emitting diode (LED) lighting strip. The bendable lighting fixture 1310 may also include a filling material 1322, for example a polyurethane filling, that produces a substantially flat surface for the bendable lighting fixture 1310, so that the bendable lighting fixture 1310 may be suitable for use in traveled surfaces, such as walkways, driveways and the like. The filling material 1322 is likewise flexible and/or bendable so that it is configured to flex and/or bend along with the bendable lighting fixture 1310. The filling material 1322 may be a transparent (see e.g. FIG. 49) or translucent (see e.g. FIG. 48) material, and may be colored, tinted or dyed to affect the light characteristics of the light emitted from the bendable lighting fixture 1310. The filling material 1322 may be poured into the profile 1312, and then cured and/or solidified to produce a substantially solid lens for the bendable lighting fixture 1310. The bendable lighting fixture 1310 may be configured to flex and/or bend in the same manner as the bendable lighting fixture 310 discussed above. The bendable lighting fixture 1310 may be suitable for indoor and outdoor lighting applications, and may be configured to be water resistant or waterproof. It is understood that the water resistance, and or water proofing, of the bendable lighting fixture 1310 may be provided at least in part by the filling material 1322 creating at least a substantially watertight seal with the profile 1312. The profile 1312 of the bendable lighting fixture 1310 may include a mounting clip edge 1331 extending at least partially along the exterior sides of the profile 1312 to provide a connection point for one or more mounting clips 1335. The mounting clips 1335 may be secured to a surface (not shown), and permit removable attachment of the bendable lighting fixture 1310 to the surface.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense. It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention.

What is claimed is:

1. A lighting fixture, comprising:

a profile having an interior region;

a lighting element disposed within the interior region of the profile; and a filling material at least partially encasing the lighting element and disposed within the interior region of the profile;

wherein the at least partial encasing of the lighting element by the filing material results in a waterproof encasement of the lighting element within the interior region of the profile; and wherein the profile, the lighting element and the filling material are configured to flex omnidirectionally.

2. The lighting fixture according to claim 1, further comprising at least one end cap positioned on an end of the profile.

3. The lighting fixture according to claim 1, further comprising a spacer lens disposed between the lighting element and the filling material.

4. The lighting fixture according to claim 1, wherein the profile comprises a floor and a pair of walls extending from the floor.

5. The lighting fixture according to claim 4, wherein at least one wall of the pair of walls extends in a curve from the floor.

6. The lighting fixture according to claim 4, wherein at least one wall of the pair of wall is configured for positioning the lighting element thereon.

7. The lighting fixture according to claim 4, wherein the floor is configured for positioning the lighting element thereon.

8. The lighting fixture according to claim 1, further comprising a louvre positioned within the interior region of the profile.

9. The lighting fixture according to claim 4, wherein at least one of the pair of walls is reflective.

10. The lighting fixture according to claim 5, wherein the at least one wall extending in a curve from the floor is reflective.

* * * * *